US010198015B1

(12) United States Patent
Ham et al.

(10) Patent No.: US 10,198,015 B1
(45) Date of Patent: Feb. 5, 2019

(54) DIGITAL LOW DROP-OUT REGULATOR AND OPERATION METHOD THEREOF

(71) Applicants: SK hynix Inc., Gyeonggi-do (KR); THE TRUSTEES OF COLUMBIA UNIVERSITY IN THE CITY OF NEW YORK, New York, NY (US)

(72) Inventors: Hyun-Ju Ham, Gyeonggi-do (KR); Jong-Hwan Kim, Seoul (KR); Min-Goo Seok, Tenafly, NJ (US); Do-Yun Kim, New York, NY (US); Sung Justin Kim, New York, NY (US)

(73) Assignees: SK Hynix Inc., Gyeonggi-do (KR); THE TRUSTEES OF COLUMBIA UNIVERSITY IN THE CITY OF NEW YORK, New York, NY (US)

( * ) Notice: Subject to any disclaimer, the term of this patent is extended or adjusted under 35 U.S.C. 154(b) by 0 days.

(21) Appl. No.: 16/005,220

(22) Filed: Jun. 11, 2018

(51) Int. Cl.
*G05F 1/56* (2006.01)
*G05F 1/575* (2006.01)

(52) U.S. Cl.
CPC ..... *G05F 1/575* (2013.01)

(58) Field of Classification Search
CPC ..... G05F 1/56; G05F 1/575
USPC ..... 323/271–282, 315
See application file for complete search history.

(56) References Cited

U.S. PATENT DOCUMENTS 5,467,009 A * 11/1995 McGlinchey ..... G05F 1/465 323/269
5,889,393 A * 3/1999 Wrathall ..... G05F 1/565 323/280
6,518,737 B1 * 2/2003 Stanescu ..... G05F 1/575 323/280
7,333,781 B1 * 2/2008 Stockstad ..... H03F 1/0205 330/129
7,450,916 B1 * 11/2008 Hietala ..... H04B 1/06 330/129
7,589,507 B2 * 9/2009 Mandal ..... G05F 1/575 323/270
8,154,263 B1 * 4/2012 Shi ..... G05F 1/575 323/269
9,030,176 B2 * 5/2015 Onouchi ..... G05F 1/59 323/268
9,870,014 B1 1/2018 Ham et al.
(Continued)

FOREIGN PATENT DOCUMENTS

KR 1020160052920 5/2016

*Primary Examiner* — Adolf Berhane
*Assistant Examiner* — Nusrat Quddus
(74) *Attorney, Agent, or Firm* — IP & T Group LLP

(57) ABSTRACT

A digital LDO regulator includes: a pulse control circuit for generating a proportional control signal based on an error code, generating an integral control signal that toggles during a first section, which includes an initialization section and an integration section, based on the proportional control signal, and generating a state information signal that defines a steady state section, the initialization section, and the integration section; a proportional control circuit for outputting a first drive signal by multiplying the error code by a proportional gain factor based on the proportional control signal; an integral control circuit for outputting a second drive signal by multiplying the error code by an integral gain factor based on the state information signal and the integral control signal; and a driver for adjusting the output voltage in response to the first drive signal and the second drive signal.

27 Claims, 14 Drawing Sheets

(56) References Cited

U.S. PATENT DOCUMENTS

| | | | | |
|---|---|---|---|---|
| 2008/0072025 | A1* | 3/2008 | Staszewski | G06F 9/30032 712/241 |
| 2008/0157733 | A1* | 7/2008 | Williams | H02M 3/07 323/266 |
| 2008/0317188 | A1* | 12/2008 | Staszewski | G04F 10/005 375/376 |
| 2017/0271981 | A1* | 9/2017 | Karlsson | H02M 3/04 |

* cited by examiner

DIGITAL LOW DROP-OUT REGULATOR AND OPERATION METHOD THEREOF

BACKGROUND

1 Field

Exemplary embodiments of the present invention relate to a semiconductor designing technology, and more specifically, to a digital Low Drop-Out (LDO) regulator including an integral control circuit.

2. Description of the Related Art

Recently, efforts have been made to achieve system-on-chip (SOC) by putting various circuits onto a single chip to keep pace with the trends for diversification and miniaturization of devices. For example, various circuits, such as analog circuits, digital circuits, and radio frequency (RF) circuits, are packaged onto a single chip. As various circuits are integrated into one chip, an efficient and stable power supply voltage management system is required.

A Low Drop-Out (LDO) regulator is one of the essential elements in a power source voltage management system and it is used to stably supply a power source voltage to the circuits. To this end, an LDO regulator is used along with a switching regulator. The LDO regulator is used primarily to supply a power source voltage to the circuits that have a small number of external circuits and are sensitive to a supplied voltage without ripple generated internally, such as an Analog-Digital Converter (ADC) and a voltage controlled oscillator (VCO).

Meanwhile, an analog LDO regulator has difficulty in that it cannot lower the power source voltage due to the use of an amplifier and it has to set a large bandwidth for a high-speed operation. In contrast, a digital LDO regulator does not use any amplifier and it may be able to greatly reduce the power source voltage while having a bandwidth that is almost infinite, which makes it easy to perform a high-speed operation.

Therefore, researchers and the industry are putting much effort in the research and development of the digital LDO regulator.

SUMMARY

Embodiments of the present invention are directed to an event-driven digital Low Drop-Out (LDO) regulator which is controlled based on a self-triggering scheme that continuously generates pulses until an output voltage reaches a stable state, during an initial regulation operation.

In accordance with an embodiment of the present invention, a digital LDO regulator includes: a pulse control circuit suitable for generating a proportional control signal based on an error code that corresponds to a change in an output voltage, generating an integral control signal that toggles during a first section, which includes an initialization section and an integration section, based on the proportional control signal, and generating a state information signal that defines a steady state section, the initialization section, and the integration section; a proportional control circuit suitable for outputting a first drive signal by multiplying the error code by a proportional gain factor based on the proportional control signal; an integral control circuit suitable for outputting a second drive signal by multiplying the error code by an integral gain factor based on the state information signal and the integral control signal; and a driver suitable for adjusting the output voltage in response to the first drive signal and the second drive signal.

In accordance with another embodiment of the present invention, a digital LDO regulator includes: a self-trigger control unit suitable for generating an integral control signal that starts toggling when a change in an output voltage is detected and stops toggling when a steady state of the output voltage is detected; an initial driving unit suitable for outputting a first integral signal by estimating a current change of an output node during an initialization section; an integral driving unit suitable for outputting a second integral signal by summing up a multiplication result which is obtained by multiplying an integral gain factor by an error code corresponding to the output voltage based on the integral control signal with a previous drive signal; a selection unit suitable for outputting a third integral signal which is generated by summing up the first integral signal with the second integral signal during the initialization section as a drive signal, and outputting the second integral signal as the drive signal during an integration section; and an array driving unit suitable for adjusting the output voltage based on the drive signal.

In accordance with yet another embodiment of the present invention, a method for operating a digital LDO regulator includes: generating an error code by detecting a change in an output voltage; activating a proportional control signal whenever the error code is changed, generating an integral control signal that toggles during a first section which includes an initialization section and an integration section based on the proportional control signal, and generating a state information signal that defines a steady state section, the initialization section, and the integration section; outputting a first drive signal by multiplying a proportional gain factor by the error code based on the proportional control signal; outputting a second drive signal by multiplying an integral gain factor by the error code based on the state information signals and the integral control signal; and adjusting the output voltage in response to the first drive signals and the second drive signal.

DETAILED DESCRIPTION

Figure 1:
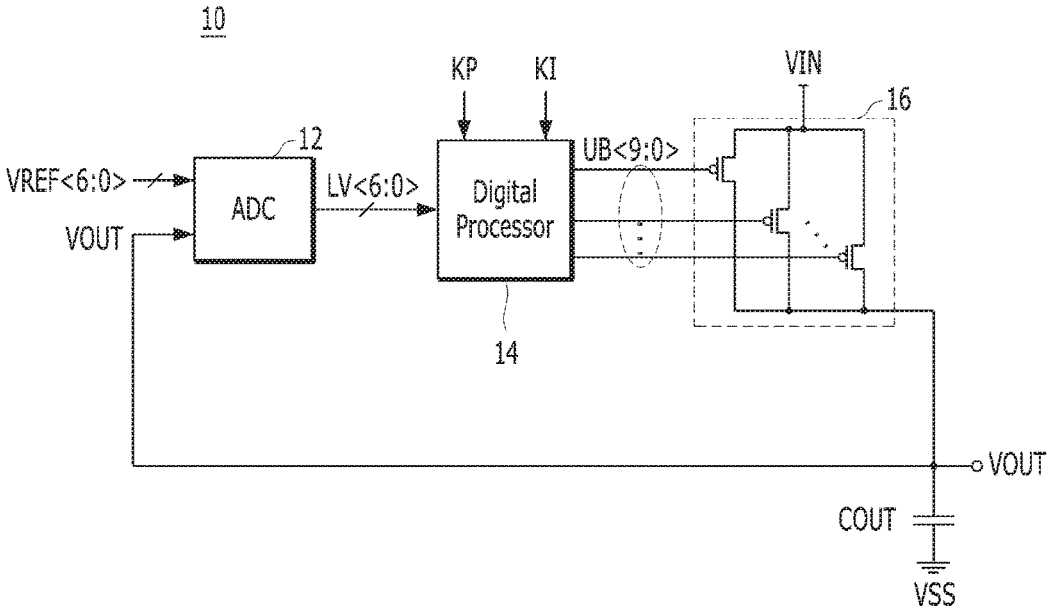
FIG. 1 (PRIOR ART)
FIG. 1 is a block diagram illustrating a conventional digital Low Drop-Out (LDO) regulator.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Furthermore, a singular form may include a plural from as long as it is not specifically stated otherwise. Like Moreover, "include/comprise" or "including/comprising" used in the specification represents that one or more components, steps, operations, and elements exist or are added.

An analog Low Drop-Out (LDO) regulator may realize a loop control through an error amplifier by feeding back an output voltage when the load current suddenly increases and the output voltage drops. The analog LDO regulator may consume excessive standby power and cause a stability problem due to the amplifier in the feedback. Also, since an off-chip output capacitor of a certain size or more has to be used for frequency compensation, the size of the circuit may become large and it is sensitive to external noise.

Along with the research on a cap-less LDO regulator from which an output capacitor is eliminated, research is being actively conducted to develop a digital LDO regulator that may operate at a high sampling frequency to reduce the size of an output capacitor.

Since control loop latency has to be shortened to eliminate an output capacitor or reduce the size of the output capacitor, an analog LDO regulator with a high-speed amplifier or a synchronous, time-driven digital LDO regulator having a high sampling frequency should be used. However, these regulators may have a concern of power consumption. Thus, an event-driven digital LDO regulator has been proposed to eliminate the correlation between the power efficiency and the control loop latency, that is, to have a short control loop latency while maintaining low power consumption.

FIG. 1 is a block diagram illustrating a conventional digital Low Drop-Out (LDO) regulator 10 of an event-driven scheme.

Referring to FIG. 1, the digital LDO regulator 10 may include an analog-digital converter (ADC) 12, a digital processor 14, and a power transistor array 16.

The analog-digital converter 12 may be fed back with an output voltage VOUT, which is an analog value, detect an error component, and output an error code LV<6:0>, which is a digital value. The analog-digital converter 12 may compare the output voltage VOUT with a reference voltage code VREF<6:0>, and output the error code LV<6:0> based on the comparison result.

The digital processor 14 may be realized as a proportional-integral (PI) controller. In other words, the digital processor 14 may include a proportional part (not shown) in charge of performing a fast regulation operation in the initial state of voltage fluctuation and an integral part (not shown) in charge of eliminating errors in a steady state. When the error code LV<6:0> is inputted, the proportional part and the integral part of the digital processor 14 may digitally process the error code LV<6:0> and generate a control signal UB<9:0> by using a proportional gain factor KP and an integral gain factor KI.

The power transistor array 16 may include a plurality of PMOS transistors that are coupled in parallel between an input voltage VIN terminal and an output voltage VOUT terminal, and control the output voltage VOUT by adjusting the number of PMOS transistors that are turned on/off according to the control signal UB<9:0>. Subsequently, the output voltage VOUT may be provided to an external capacitor COUT.

As described above, differently from a time-driven digital regulator, the event-driven digital LDO regulator 10 may decide that an event has occurred only when the error code LV<6:0> changes and generate the control signal UB<9:0>, and maintains the output voltage VOUT at a constant voltage level by controlling the number of transistors of the power transistor array 16 that are turned on/off based on the generated control signal UB<9:0>. Therefore, compared to the time-driven digital LDO regulator, the event-driven digital LDO regulator 10 may be able to operate with a shorter control latency at a lower power consumption.

Figure 2:
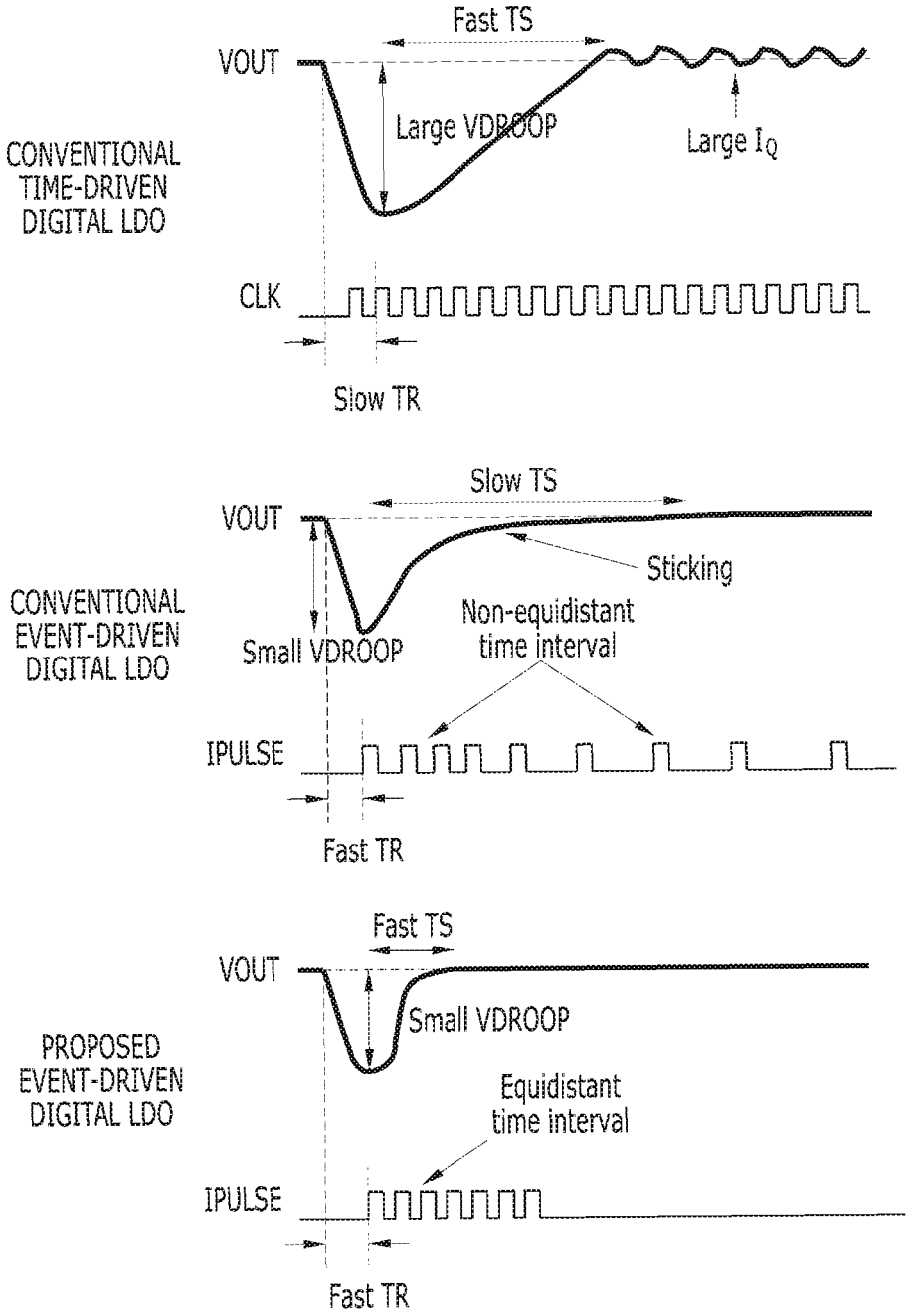
FIG. 2 is a timing diagram describing an operation of a digital LDO regulator in accordance with an embodiment of the present invention.

FIG. 2 is a timing diagram describing an operation of a digital LDO regulator in accordance with an embodiment of the present invention.

Referring to FIG. 2, the time-driven digital LDO regulator may have a limitation in improving a response time TR due to a sampling frequency of a clock CLK used. Herein, the response time TR may mean the time required to detect/sample the first error of the output voltage VOUT of the LDO regulator. As the response time becomes longer, the voltage drop VDROOP of the output voltage VOUT becomes greater and a larger output capacitor is required. Since the time-driven digital LDO regulator operates based on a relatively fast clock CLK, the settling time TS defined as the time taken to recover the voltage drop VDROOP may be shortened to contribute to fast regulation performance.

On the other hand, since the conventional event-driven digital LDO regulator operates according to a trigger (e.g., 'IPULSE' in FIG. 2) activated when a change in the output voltage VOUT is detected, the event-driven digital LDO regulator may improve the response time TR. Thus, the voltage drop VDROOP may be relatively small. However, since the trigger IPULSE is activated only when a significant change in the output voltage VOUT is detected, the settling time TS may become longer and the event-driven digital LDO regulator may come to have slow regulation performance. Further, in the conventional event-driven digital LDO regulator, the trigger is not activated when the change in the output voltage VOUT is relatively small so as not to be detected. In this case, a sticking concern may occur since a regulation operation is not performed even if the output voltage VOUT does not reach a steady state.

The proposed event-driven digital LDO regulator according to the embodiment of the present invention may control the integral part according to a self-triggering scheme that continuously generates the trigger IPULSE until the output voltage VOUT reaches a steady state. In other words, since the proposed digital LDO regulator improves the settling time TS by quickly performing an integral calculation, the digital LDO regulator may improve the settling time TS as well as the response time TR simultaneously. Therefore, there is an effect that the regulation performance of the digital LDO regulator is improved. Further, since the proposed event-driven digital LDO regulator may perform a regulation operation according to the self-triggering scheme that continuously generates the trigger IPULSE until the output voltage VOUT reaches the steady state, the sticking concern may not occur. Thus, since it does not need to require a complex circuit necessary for addressing the sticking concern, it may be possible to decrease the area and reduce the power consumption.

Hereafter, the embodiment of the present invention is described specifically with reference to the accompanying drawing.

Figure 3:
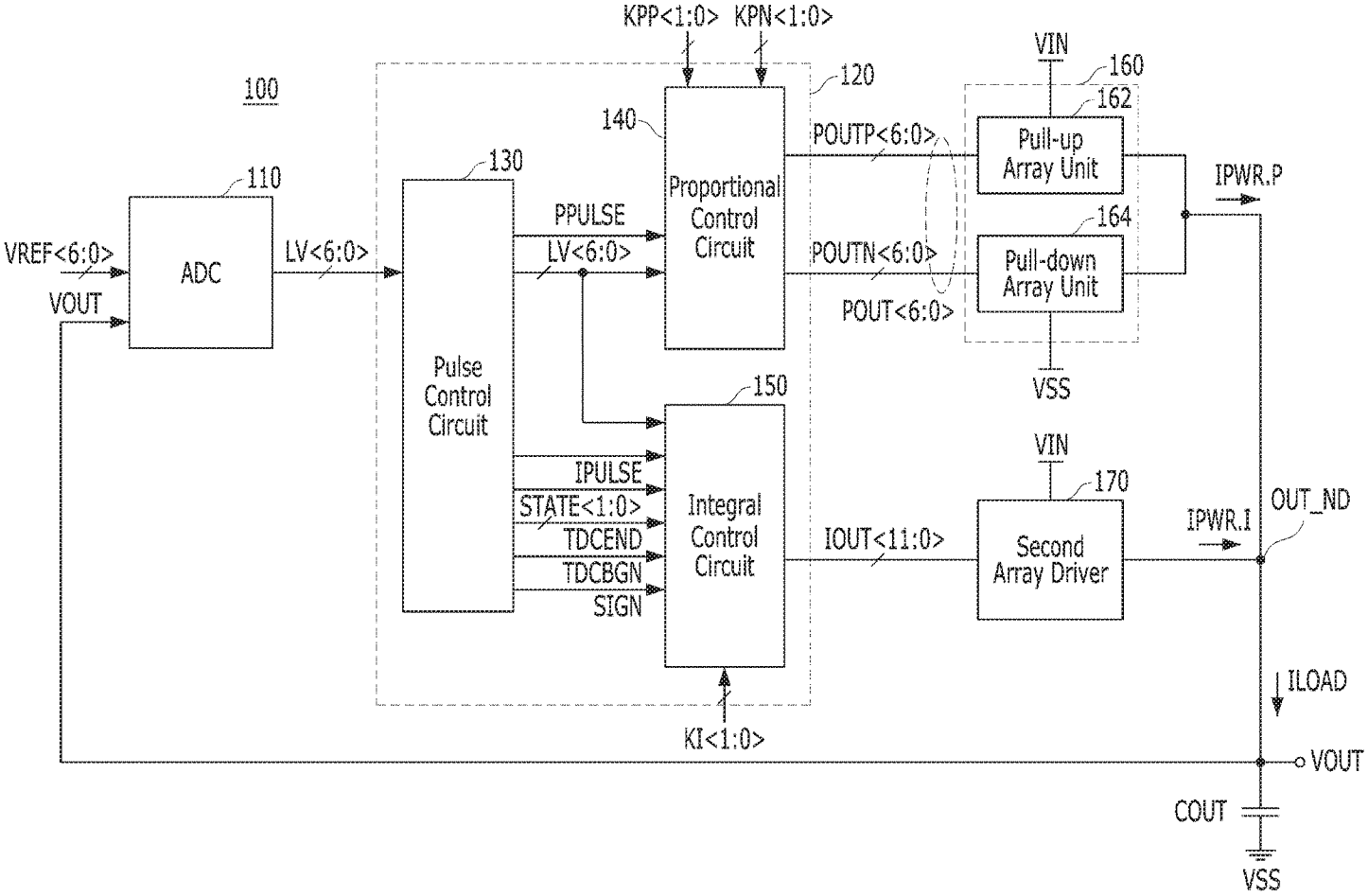
FIG. 3 is a block diagram describing a digital LDO regulator in accordance with an embodiment of the present invention.
Figure 4A:
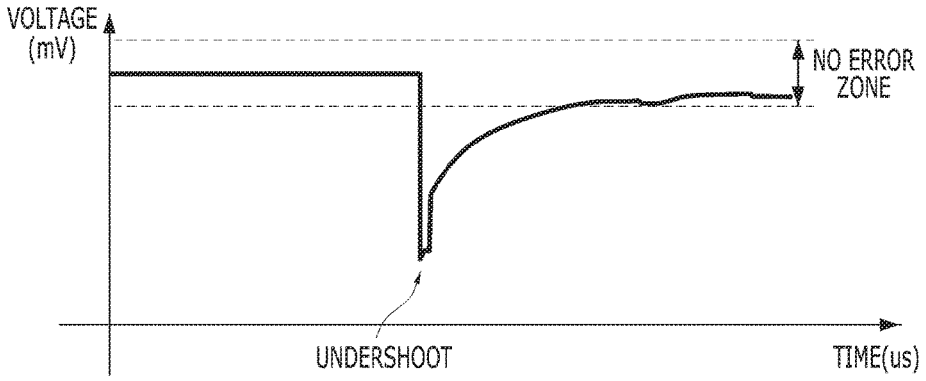
FIGS. 4A and 4B are waveform diagrams describing undershoot and overshoot of an output voltage, respectively.
Figure 4B:
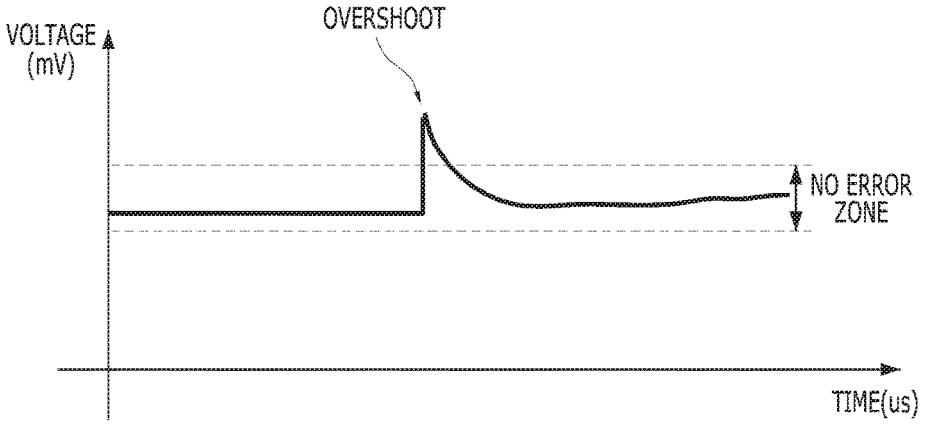

FIG. 3 is a block diagram describing a digital LDO regulator 100 in accordance with an embodiment of the present invention. FIGS. 4A and 4B are waveform diagrams describing undershoot and overshoot of the output voltage VOUT, respectively.

Referring to FIG. 3, the digital LDO regulator 100 may include an analog-digital converter (ADC) 110, a digital processor 120, a first array driver 160, and a second array driver 170.

The analog-digital converter 110 may detect an error component of the analog output voltage VOUT outputted from an output node OUT_ND and output a digital error code LV<6:0>. The analog-digital converter 110 may asynchronously compare the output voltage VOUT with a reference voltage code VREF<6:0> and detect a change, such as an overshoot or an undershoot of the output voltage VOUT, as an error component, and output a multi-bit error code LV<6:0> based on the detected change. Herein, the error code LV<6:0> may be formed of a thermometer code (that is, a unary code). For example, when the analog-digital converter 110 outputs a 7-bit error code LV<6:0>, the number of '1's of the error code LV<6:0> may be decided based on the overshoot or undershoot of the output voltage VOUT as shown in Table 1.

TABLE 1

| Change in Output Voltage VOUT | Error Code LV<6:0> |
|---|---|
| Undershoot | 0000001 |
| Undershoot | 0000011 |
| Undershoot | 0000111 |
| No Error | 0001111 |
| Overshoot | 0011111 |
| Overshoot | 0111111 |
| Overshoot | 1111111 |

Hereinafter, it may be assumed that when the output voltage VOUT is within a No Error Zone where there is no substantial change within a target range, which is a steady state, the analog-digital converter 110 outputs the error code LV<6:0> of '0001111'. When the output voltage VOUT undershoots from the no error zone, as illustrated in FIG. 4A, or when the output voltage VOUT overshoots from the no error zone, as illustrated in FIG. 4B, the analog-digital converter 110 may detect a change in the output voltage VOUT as an error component and generate the error code LV<6:0> based on the detected change.

The digital processing circuit 120 may be realized as a proportional-integral (PI) controller. The digital processing circuit 120 may include a pulse control circuit 130, a proportional control circuit 140, and an integral control circuit 150.

The pulse control circuit 130 may generate a proportional control signal PPULSE based on the error code LV<6:0> and generate an integral control signal IPULSE that toggles during a first section based on the proportional control signal PPULSE. The pulse control circuit 130 may begin at the first rising edge of the proportional control signal PPULSE (which will be referred to as 'a first activation', hereinafter), and a section that ends when the error code LV<6:0> is maintained to the steady state of the output voltage VOUT (for example, '0001111') for a predetermined period of the integral control signal IPULSE may be defined as a first section. Herein, the first section may include an initialization section which is maintained during at least one initial period (e.g., an initial first period) of the integral control signal IPULSE and an integration section which is not the initialization section. Also, the pulse control circuit 130 may define a section excluding the first section as a steady-state section. The pulse control circuit 130 may generate at least two bits of a state information signal STATE<1:0> for defining a steady state section, the initialization section, and the integration section. Furthermore, the pulse control circuit 130 may generate a start signal TDCBGN and an end signal TDCEND based on the error code LV<6:0>. The pulse control circuit 130 may output information indicating or representing whether a change of the error code LV<6:0> is overshoot or undershoot as an error sign signal SIGN.

The proportional control circuit 140 may multiply the proportional gain factors KPP<1:0> and KPN<1:0> by the error code LV<6:0> based on the proportional control signal PPULSE, and output a first drive signal POUT<6:0>. The first drive signal POUT<6:0> may include a pull-up control signal POUTP<6:0> and a pull-down control signal POUTN<6:0>. For example, the proportional control circuit 140 may latch the error code LV<6:0> based on the proportional control signal PPULSE, and output the pull-up control signal POUTP<6:0> and the pull-down control signal POUTN<6:0> by shifting the error code that is latched based on the first and second proportional gain factors KPP<1:0> and KPN<1:0>.

The integral control circuit 150 may multiply the integral gain factor KI<1:0> by the error code LV<6:0> based on the state information signal STATE<1:0> and the integral control signal IPULSE, and output a second drive signal IOUT<11:0>. To be more specific, the integral control circuit 150 may estimate a current change ΔILOAD of the output node OUT_ND during the initial period based on the state information signal STATE<1:0>, sum up the estimated current change ΔILOAD and the previous second drive signal, and output the second drive signal IOUT<11:0>. Also, the integral control circuit 150 may sum up a multiplication result, which is obtained by multiplying the integral gain factor KI<1:0> by the error code LV<6:0>, and the previous second drive signal according to the integral control signal IPULSE during the integration section based on the state information signal STATE<1:0>, and output the second drive signal IOUT<11:0>. Particularly, the integration control circuit 150 may calculate an activation section ΔT defined by the start signal TDCBGN and the end signal TDCEND during the initialization section, and estimate the current change ΔILOAD of the output node OUT_ND compared with the activation section ΔT based on the error sign signal SIGN. Herein, the integral control circuit 150 may estimate the current change ΔILOAD of the output node OUT_ND based on the fact that the current change ΔILOAD and the activation section ΔT are in inverse proportion to each other.

The first array driver 160 may adjust the output voltage VOUT in response to the first drive signal POUT<6:0>. The first array driver 160 may adjust the driving force of the first current IPWR.P in response to the pull-up control signal POUTP<6:0> and the pull-down control signal POUTN<6:0> and output it to the output node OUT_ND.

The first array driver 160 may include a pull-up array unit 162 for compensating for undershoot of the output voltage VOUT and a pull-down array unit 164 for compensating for overshoot of the output voltage VOUT. The pull-up array unit 162 may include a plurality of pull-up transistors (not shown) that are coupled in parallel between the power source voltage VIN terminal and the output node OUT_ND, and control the number of pull-up transistors that are turned on in response to the pull-up control signal POUTP<6:0>. The pull-down array unit 164 may include a plurality of pull-down transistors (not shown) that are coupled in parallel between the output node OUT_ND and the ground voltage terminal and control the number of pull-down transistors that are turned on in response to the pull-down control signal POUTN<6:0>.

The second array driver 170 may adjust the output voltage VOUT in response to the second drive signal IOUT<11:0>. The second array driver 170 may adjust the driving force of the second current IPWR.I in response to the second drive signal IOUT<11:0> and output it to the output node OUT_ND.

The second array driver 170 may include a plurality of pull-up transistors (not shown) that are coupled in parallel between the power source voltage VIN terminal and the output node OUT_ND, and control the number of pull-up transistors that are turned on in response to the second drive signal IOUT<11:0>. In general, since the overshoot is more easily controlled than undershoot, the second array driver 170 may be formed to include only pull-up transistors for compensating for undershoot of the output voltage VOUT. However, according to an embodiment of the present invention, the second array driver 170 may further include a plurality of pull-down transistors that are coupled in parallel between the output node OUT_ND and a ground voltage VSS terminal.

The output voltage VOUT whose driving force is adjusted by the first array driver 160 and the second array driver 170 may be provided to an external capacitor COUT through the output node OUT_ND.

The operation of the digital LDO regulator 100 having the above-described structure is briefly described as follows.

The analog-digital converter 110 may detect an error component of the analog output voltage VOUT outputted from the output node OUT_ND and output the digital error code LV<6:0>.

The pulse control circuit 130 may activate the proportional control signal PPULSE whenever the error code LV<6:0> is changed, and generate the integral control signal IPULSE that toggles during the first section including the initialization section and the integration section based on the proportional control signal PPULSE.

The proportional control circuit 140 may respectively multiply the first and second proportional gain factors KPP<1:0> and KPN<1:0> by the error code LV<6:0> according to the proportional control signal PPULSE, and output the pull-up control signal POUTP<6:0> and the pull-down control signal POUTN<6:0> of the first drive signal POUT<6:0>.

The integral control circuit 150 may estimate the current change ΔILOAD of the output node OUT_ND during the initialization section of the first section, and sum up the estimated current change ΔILOAD and the previous second drive signal, and output the second drive signal IOUT<11:0>. Thereafter, the integral control circuit 150 may multiply a multiplication result, which is obtained by multiplying the integral gain factor KI<1:0> by the error code LV<6:0>, and the previous second drive signal based on the integral control signal IPULSE during the integration section of the first section, and the second drive signal IOUT<11:0>.

The first and second array drivers 160 and 170 may adjust the output voltage VOUT in response to the first drive signal POUT<6:0> and the second drive signal IOUT<11:0>.

As described above, the event-driven digital LDO regulator 100 in accordance with the embodiment of the present invention may control the integral control circuit 150 based on the self-triggering scheme that generates the integral control signal IPULSE which toggles at a predetermined cycle until the output voltage VOUT reaches a steady state. Therefore, since the integral control circuit 150 is triggered even through the output voltage VOUT is not changed, the integral calculation may be performed quickly, thereby improving the response time and the settling time, thereby improving the regulation performance. Furthermore, since the output voltage VOUT is adjusted to reach the target voltage during the integration section after the estimated current change ΔILOAD is compensated during the initialization section, the settling time may be remarkably reduced.

Figure 5:
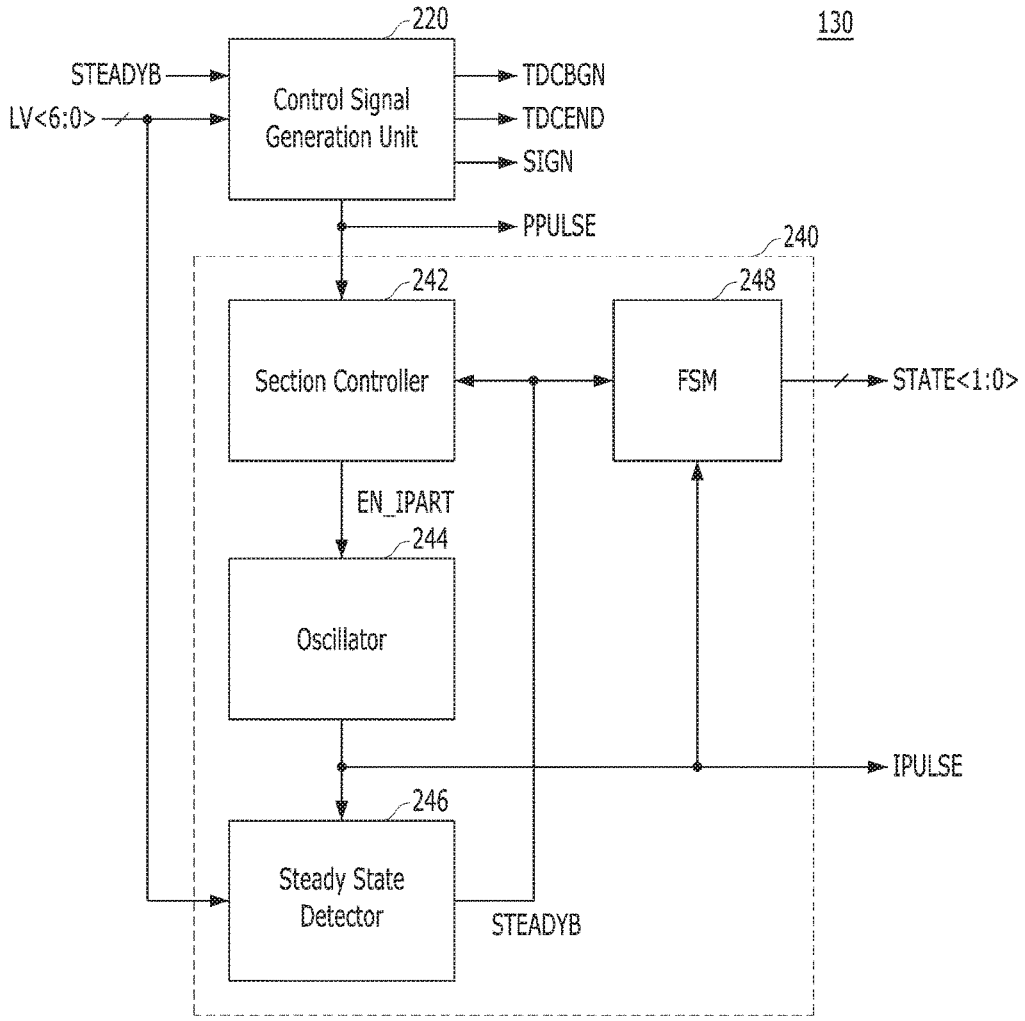
FIG. 5 is a block diagram illustrating a pulse control circuit shown in FIG. 3.

FIG. 5 is a block diagram illustrating the pulse control circuit 130 shown in FIG. 3.

Referring to FIG. 5, the pulse control circuit 130 may include a control signal generation unit 220 and a self-trigger control unit 240. The control signal generation unit 220 and the self-trigger control unit 240 may include all circuits, systems, firmware and devices necessary for their respective operations and functions.

The control signal generation unit 220 may receive the 7-bit error code LV<6:0> and a steady state detection signal STEADYB, and generate the proportional control signal PPULSE, the start signal TDCBGN, the end signal TDCEND and an error sign signal SIGN. The control signal generation unit 220 may generate the proportional control signal PPULSE that pulses whenever the 7-bit error code LV<6:0> is changed. The proportional control signal PPULSE may be a pulse signal that is activated for a predetermined period. The control signal generation unit 220 may generate the start signal TDCBGN that is activated according to a first activation of the proportional control signal PPULSE and deactivated according to the steady state detection signal STEADYB. The control signal generation unit 220 may generate the end signal TDCEND that is activated according to a second activation of the proportional control signal PPULSE and deactivated according to the steady state detection signal STEADYB. The control signal generating unit 220 may generate the error sign signal SIGN indicating overshoot or undershoot of the output voltage VOUT based on the error code LV<6:0>. For example, when the error code LV<6:0> is overshoot or a no error where there is no change, the control signal generation unit 220 may output the error sign signal SIGN at a logic low level, and when the error code LV<6:0> is undershoot, the control signal generation unit 220 may output the error sign signal SIGN at a logic high level.

The self-trigger control unit 240 may generate the integral control signal IPULSE, at least two bits of the state information signal STATE<1:0>, and the steady state detection signal STEADYB based on the proportional control signal PPULSE and the error code LV<6:0>. The state information signal STATE<1:0> may be a signal that defines the steady state section, the initialization section, and the integration section. The steady state detection signal STEADYB may be a signal for detecting the steady state section. For example, the steady state detection signal STEADYB may be a signal that is activated to a logic low level during the steady state section, and deactivated to a logic high level during a section which is not a steady state section, i.e., during the first section. The self-trigger control unit 240 may start the toggling according to the activation of the proportional control signal PPULSE and generate the integral control signal IPULSE to stop the toggling according to the activation of the steady state detection signal STEADYB.

More specifically, the self-trigger control unit 240 may include a section controller 242, an oscillator 244, a steady state detector 246, and a finite state machine (FSM) 248.

The section controller 242 may generate a section control signal EN_IPART which is activated based on the proportional control signal PPULSE and deactivated in accordance with the steady state detection signal STEADYB. The section controller 242 may be realized with a set-reset (SR) latch (not shown) that receives the proportional control signal PPULSE as a set signal and receives the steady state detection signal STEADYB as a reset signal. According to the embodiment, the section controller 242 may be realized with a flip-flop (not shown) that receives the proportional control signal PPULSE as a set signal, receives a global reset signal (not shown) as a reset signal, and when the integral control signal IPULSE is inputted, latches and outputs the steady state detection signal STEADYB as the section control signal EN_IPART.

The oscillator 244 may generate the integral control signal IPULSE that may be enabled according to the section control signal EN_IPART and toggles at predetermined cycle. The oscillator 244 may be realized with a ring oscillator (not shown).

The steady state detector 246 may generate the steady state detection signal STEADYB based on the integral control signal IPULSE and the error code LV<6:0>. The steady state detector 246 may generate the steady state detection signal STEADYB that is activated to a logic low level, when the error code LV<6:0> corresponding to the steady state of the output voltage VOUT is maintained for a predetermined period, e.g., 8 cycles, of the integral control signal IPULSE.

The finite state machine 248 may generate the state information signal STATE<1:0> based on the integral control signal IPULSE and the steady state detection signal STEADYB. For example, the finite state machine 248 may generate the state information signal STATE<1:0> of a first value (e.g., "00") in the steady state section, and generate the state information signal STATE<1:0> of a second value (e.g., "10") in the initialization section, and generate the state information signal STATE<1:0> of a third value (e.g., "11") in the integration section.

Figure 6:
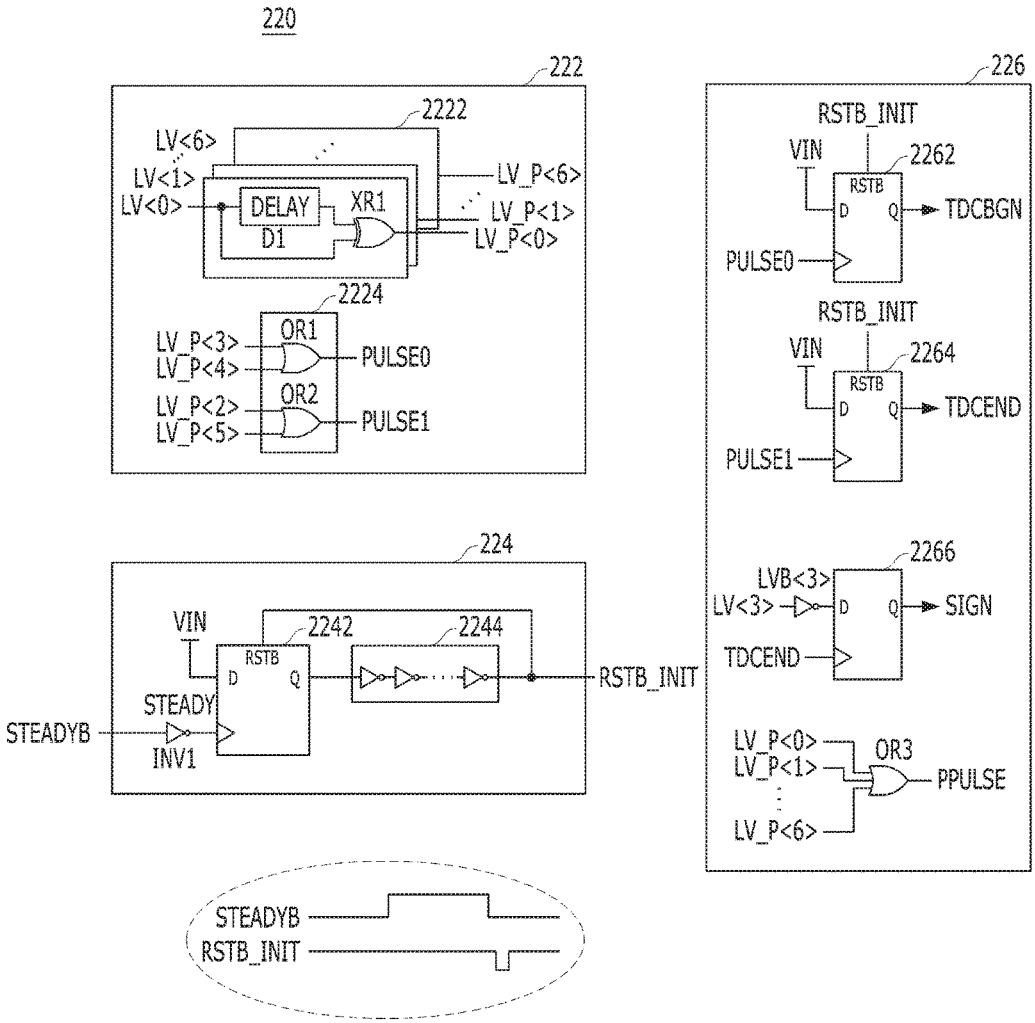
FIG. 6 is a circuit diagram illustrating a control signal generation unit shown in FIG. 5.

FIG. 6 is a circuit diagram illustrating the control signal generation unit 220 shown in FIG. 5.

Referring to FIG. 6, the control signal generation unit 220 may include a pulse generator 222, a reset signal generator 224, and a signal outputter 226.

The pulse generator 222 may generate first to seventh pulse signals LV_P<6:0> corresponding to the bits of the 7-bit error code LV<6:0>, respectively, and pulse for a predetermined section whenever the corresponding bit is changed. For example, the second pulse signal LV_P<1> may pulse for a predetermined section when the level of the second bit LV<1> of the error code LV<6:0> is changed. Also, the pulse generator 222 may generate a first pulse control signal PULSE0 that is activated when any one between the fourth pulse signal LV_P<3> and the fifth pulse signal LV_P<4> is activated, and the pulse generator 222 may generate a second pulse control signal PULSE1 that is activated when any one between the third pulse signal LV_P<2> and the sixth pulse signal LV_p<5> is activated.

To be specific, the pulse generator 222 may include a plurality of first pulse generation elements 2222 and a second pulse generation element 2224.

Each of the first pulse generation elements 2222 may include a delayer D1 for receiving and delaying the corresponding bit and an XOR gate XR1 for performing an XOR operation onto the output of the delayer D1 and the corresponding bit. The second pulse generation element 2224 may include a first OR gate OR1 that generates the first pulse control signal PULSE0 by performing an OR operation onto the fourth pulse signal LV_P<3> or the fifth pulse signal LV_P<4>, and a second OR gate OR2 that generates the second pulse control signal PULSE1 by performing an OR operation onto the third pulse signal LV_P<2> or the sixth pulse signal LV_P<5>.

The reset signal generator 224 may generate an internal reset pulse RSTB_INIT based on the steady state detection signal STEADYB.

To be specific, the reset signal generator 224 may include a first flip-flop 2242 and a reset pulse generation element 2244. The first flip-flop 2242 may be reset based on the internal reset pulse RSTB_INIT, and may output the power source voltage VIN as an output signal when an inverted signal STEADY of the steady state detection signal STEADYB is inputted. The reset pulse generation element 2244 may generate the internal reset pulse RSTB_INIT by delaying and inverting the output signal of the first flip-flop 2242. According to an embodiment of the present invention, the first flip-flop 2242 may be realized with a D-flip-flop. In other words, the reset signal generator 224 may generate the internal reset pulse RSTB_INIT that pulses to a logic low level for a predetermined time in response to a falling edge of the steady state detection signal STEADYB.

The signal outputter 226 may generate the start signal TDCBGN which is activated based on the first pulse control signal PULSE0 and deactivated based on the internal reset pulse RSTB_INIT, and generate the end signal TDCEND which is activated based on the second pulse control signal PULSE1 and deactivated based on the internal reset pulse RSTB_INIT. The signal outputter 226 may output the inverted signal LVB<3> of the middle bit (i.e., the fourth bit LV<3>) of the error code LV<6:0> as the error sign signal SIGN in response to the end signal TDCEND. Also, the signal outputter 226 may generate the proportional control signal PPULSE that is activated when any one between the first to seventh pulse signals LV_P<6:0> is activated. Herein, according to the embodiment of the present invention, since the error sign signal SIGN is used only in the initialization section, it may have effective information only in the initialization section. In other words, the error sign signal SIGN may provide information indicating whether the change of the error code LV<6:0> is overshoot or undershoot only in the initial section. However, the spirit and concept of the present invention are not limited to it, and the signal outputter 226 may output the inverted signal LVB<3> of the middle bit (i.e., the fourth bit LV<3>) of the error code LV<6:0> as an error sign signal SIGN.

To be specific, the signal outputter 226 may include a second flip-flop 2262, a third flip-flop 2264, a fourth flip-flop 2266, and a third OR gate OR3.

The second flip-flop 2262 may be reset based on the internal reset pulse RSTB_INIT, and output the power source voltage VIN as the start signal TDCBGN when the first pulse control signal PULSE0 is inputted. The third flip flop 2264 may be reset based on the internal reset pulse RSTB_INIT and may output the power source voltage VIN as the end signal TDCEND when the second pulse control signal PULSE1 is inputted. The fourth flip-flop 2266 may output the inverted signal LVB<3> of the fourth bit LVB<3>) as the error sign signal SIGN when the end signal TDCEND is inputted. According to an embodiment of the present invention, the second to fourth flip-flops 2262 to 2266 may be realized with D-flip-flops. The third gate OR3 may generate the proportional control signal PPULSE by performing an OR operation onto the first to seventh pulse signals LV_P<6:0>.

Figure 7:
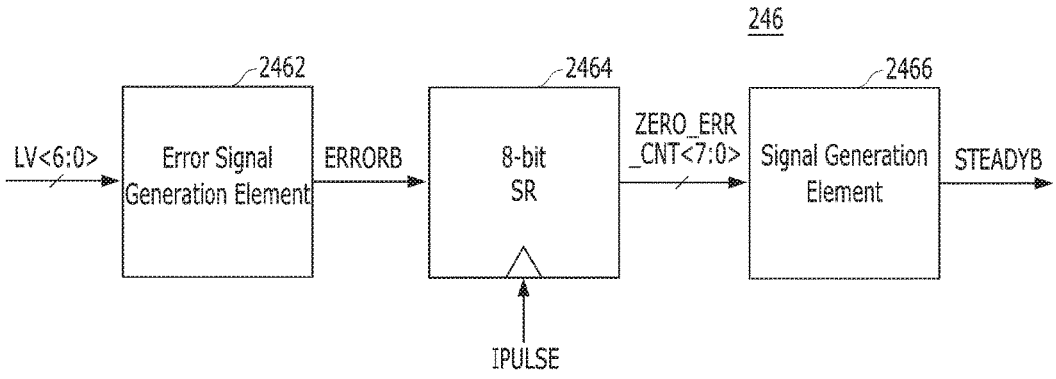
FIG. 7 is a block diagram illustrating a steady state detector shown in FIG. 5.

FIG. 7 is a block diagram illustrating the steady state detector 246 shown in FIG. 5.

Referring to FIG. 7, the steady state detector 246 may include an error signal generation element 2462, an 8-bit shift register element SR 2464, and a signal generation element 2466.

The error signal generation element 2462 may generate an error detection signal ERRORB by detecting whether an error code LV<6:0> corresponding to the steady state (i.e., 0001111) is inputted. The error signal generation element 2462 may generate the error detection signal ERRORB that is deactivated to a logic high level when the error code LV<6:0> corresponding to "0001111" is inputted. For example, the error signal generation element 2462 may be formed of a logic (not shown) that performs an AND operation onto the fourth bit LV<3> of the error code LV<6:0> and an inverted signal of the fifth bit LV<4> of the error code LV<6:0>.

The 8-bit shift register element SR 2464 may output an8-bit no-error counting signal ZERO_ERR_CNT<7:0> by sequentially shifting the error detection signal ERRORB based on the integral control signal IPULSE. For example, the 8-bit shift register element SR 2464 may be formed of first to eighth flip-flops (not shown) that are serially connected and operate in synchronization with the integral control signal IPULSE. The 8-bit no-error counting signal ZERO_ERR_CNT<7:0> may be outputted from each of the outputs of the first to eighth flip-flops.

The signal generation element 2466 may generate the steady state detection signal STEADYB that is deactivated based on the no-error counting signal ZERO_ERR_CNT<7:0>. The signal generation element 2466 may activate the steady state detection signal STEADYB to a logic low level when all the bits of the no-error counting signal ZERO_ERR_CNT<7:0> are at a logic high level, and deactivate the steady state detection signal STEADYB to a logic high level when any one bit of the no-error counting signal ZERO_ERR_CNT<7:0> is at a logic low level. For example, the signal generation element 2466 may be formed of a logic (not shown) that performs a logic NAND operation onto each bit of the no-error counting signal ZERO_ERR_CNT<7:0>.

Figure 8:
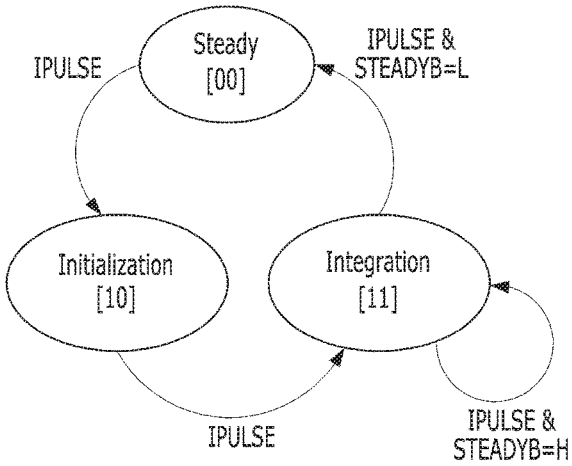
FIG. 8 is a diagram illustrating an operation of a Finite State Machine (FSM) shown in FIG. 5.

FIG. 8 is a diagram illustrating an operation of the finite state machine (FSM) 248 shown in FIG. 5.

Referring to FIG. 8, the finite state machine 248 may generate a state information signal STATE<1:0> having three states. The finite state machine 248 may decide that the section is the steady state section when the integral control signal IPULSE is deactivated and the steady state detection signal STEADYB is activated to a logic low level, and generate the state information signal STATE<1:0> to be "00" which corresponds to the steady state section. When the integral control signal IPULSE is activated, that is, when the state information signal STATE<1:0> is "00" at a rising edge of the integral control signal IPULSE, the finite state machine 248 may transition the state information signal STATE<1:0> to "10" which corresponds to the initialization section. when the state information signal STATE<1:0> is "10" at a rising edge of the integral control signal IPULSE, the finite state machine 248 may transition the state information signal STATE<1:0> to "11" which corresponds to the integration section. When the state information signal STATE<1:0> is "11" and the steady state detection signal STEADYB is deactivated to a logic high level at a rising edge of the integral control signal IPULSE, the finite state machine 248 may maintain the state information signal STATE<1:0> to "11" which corresponds to the integration section, and when the steady state detection signal STEADYB is activated to a logic low level while the state information signal STATE<1:0> is "11" at a rising edge of the integral control signal IPULSE, the finite state machine 248 may transition the state information signal STATE<1:0> to "00" which corresponds to the steady state section.

Hereinafter, the operation of the pulse control circuit 130 will be described with reference to FIGS. 5 to 9.

Figure 9:
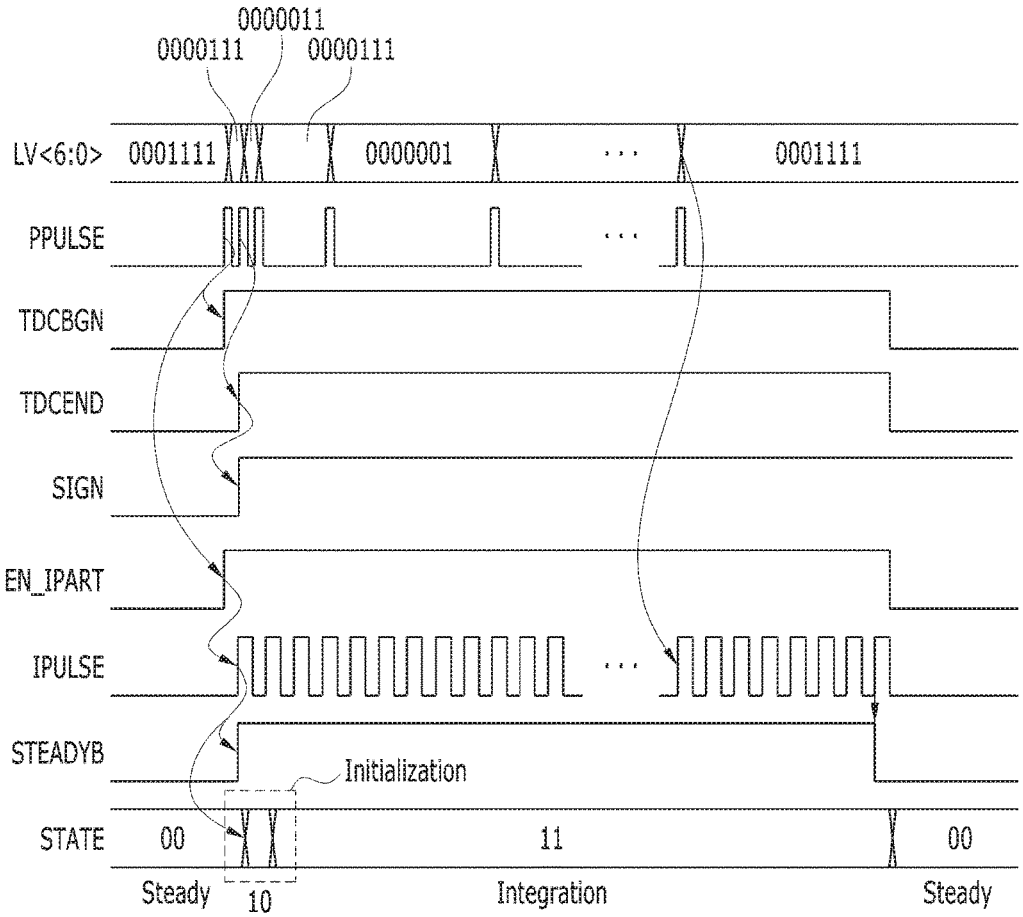
FIG. 9 is a timing diagram illustrating an operation of the pulse control circuit shown in FIG. 5.

FIG. 9 is a timing diagram illustrating an operation of the pulse control circuit 130 shown in FIG. 5.

Referring to FIG. 9, a case where an undershoot occurs in the steady-state analog output voltage VOUT is illustrated.

When the steady-state analog output voltage VOUT is inputted, the analog-digital converter 110 may detect that there is no error component (NO-ERROR) and output a digital error code LV<6:0> of "0001111" which corresponds to the steady state. The control signal generation unit 220 may deactivate the proportional control signal PPULSE, and the self-trigger control unit 240 may deactivate the integral control signal IPULSE. In addition, the steady state detector 246 of the self-trigger control unit 240 may activate and output the steady state detection signal STEADYB to a logic low level. Accordingly, the finite state machine 248 may generate the state information signal STATE<1:0> of "00" which corresponds to the steady state section.

Hereafter, the analog-digital converter 110 may detect an undershoot of the output voltage VOUT and output a digital error code LV<6:0> of "0000111", "0000011", or "000001".

The control signal generation unit 220 may generate the proportional control signal PPULSE that pulses every time the 7-bit error code LV<6:0> is changed. Also, the control signal generation unit 220 may activate the start signal TDCBGN in accordance with the first activation of the proportional control signal PPULSE and activate the end signal TDCEND according to the second activation of the proportional control signal PPULSE. Herein, when the end signal TDCEND is activated, the control signal generation unit 220 may output the inverted signal LVB<3> of the fourth bit LV<3> as the error sign signal SIGN.

The section controller 242 of the self-trigger control unit 240 may activate the section control signal EN_IPART in accordance with the proportional control signal PPULSE, and the oscillator 244 may generate the integral control signal IPULSE that toggles at a predetermined cycle when the section control signal EN_IPART is activated. The steady state detector 246 may deactivate the steady state detection signal STEADYB to a logic high level. Herein, when the state information signal STATE<1:0> is "00", the finite state machine 248 may transition the state information signal STATE<1:0> to "10" which corresponds to the initialization section at a rising edge of the integral control signal IPULSE.

When the state information signal STATE<1:0> is "10", the finite state machine 248 may transition the state information signal STATE<1:0> to "11" which corresponds to the integration section at a following-up rising edge of the integral control signal IPULSE.

Subsequently, when the output voltage VOUT of the steady state is inputted, the analog-digital converter 110 may detect no error component (NO-ERROR) and output the digital error code LV<6:0> of "0001111".

The steady state detector 246 may activate the steady state detection signal STEADYB to a logic low level, when the error code LV<6:0> corresponding to the steady state of the output voltage VOUT is maintained for eight cycles of the integral control signal IPULSE. As a result, the control signal generation unit 220 may deactivate the start signal TDCBGN and the end signal TDCEND, and the section controller 242 may deactivate the section control signal EN_IPART. The oscillator 244 may stop toggling the integral control signal IPULSE according to the section control signal EN_IPART, and the finite state machine 248 may transition the state information signal STATE<1:0> to "00" which corresponds to the steady-state section when the steady state detection signal STEADYB is activated while the state information signal STATE<1:0> is "11" at a rising edge of the integral control signal IPULSE.

Figure 10:
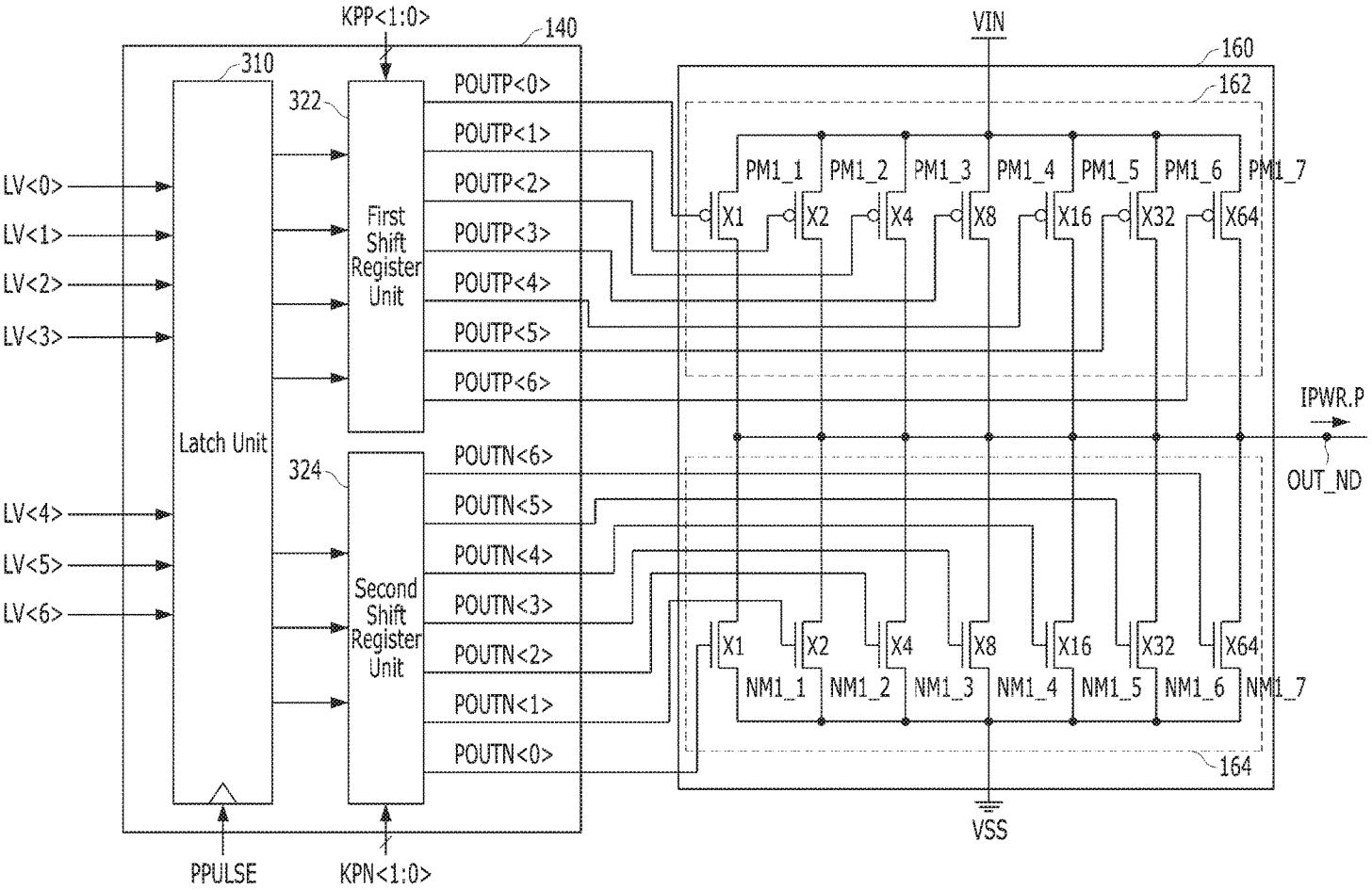
FIG. 10 is a block diagram illustrating a proportional control circuit and a first array driver shown in FIG. 3.

FIG. 10 is a block diagram illustrating the proportional control circuit 140 and the first array driver 160 shown in FIG. 3.

Referring to FIG. 10, the proportional control circuit 140 may include a latch unit 310, a first shift register unit 322, and a second shift register unit 324.

The latch unit 310 may store an error code LV<6:0> in response to the proportional control signal PPULSE. According to an embodiment of the present invention, the latch unit 310 may be realized with a plurality of D flip-flops that receive the proportional control signal PPULSE through a clock terminal. The first shift register unit 322 may shift a lower bit group LV<3:0> of the error code LV<6:0> which is latched based on the first proportional gain factor KPP<1:0> and output a pull-up control signal POUTP<6:0>. The second shift register unit 324 may shift an upper bit group LV<6:4> of the error code LV<6:0> which is latched based on the second proportional gain factor KPN<1:0> and output a pull-down control signal POUTN<6:0>.

The pull-up array unit 162 of the first array driver 160 may receive each bit of the pull-up control signal POUTP<6:0> through a gate and include first to seventh pull-up transistors PM1_1 to PM1_7 that are coupled in parallel between the power source voltage VIN stage and the output node OUT_ND. Therefore, the pull-up array unit 162 may control the number of pull-up transistors PM1_1 to PM1_7 that are turned on in response to the pull-up control signal POUTP<6:0>. According to an embodiment of the present invention, the first to seventh pull-up transistors PM1_1 to PM1_7 may be realized with PMOS transistors.

The pull-down array unit 164 of the first array driver 160 may receive each bit of the pull-down control signal POUTN<6:0> through a gate and include first to seventh pull-down transistors NM1_1 to NM1_7 that are coupled in parallel between the output node OUT_ND and the ground voltage VSS terminal. Therefore, the pull-down array unit 164 may control the number of pull-down transistors NM1_1 to NM1_7 that are turned on in response to the pull-down control signal POUTN<6:0>. According to an embodiment of the present invention, the first to seventh pull-down transistors NM1_1 to NM1_7 may be realized with NMOS transistors.

Meanwhile, the first to seventh pull-up transistors PM1_1 to PM1_7 may be formed to have a size (W/L) that increases by two times. Herein, the size of a transistor represents the ratio of the width (W) per length of the gate thereof. For example, the seventh pull-up transistor PM1_7 receiving the seventh bit POUTP<6> of the pull-up control signal POUTP<6:0> may be formed to have $2^6$=64 times as big as the size of the first pull-up transistor PM1_1 which receives the first bit POUTP<0> of the pull-up control signal POUTP<6:0>. Likewise, the first to seventh pull-down transistors NM1_1 to NM1_7 may be formed to have a size (W/L) that increases by two times. In other words, since the first to seventh pull-up transistors PM1_1 to PM1_7 or the first to seventh pull-down transistors NM1_1 to NM1_7 have a size increasing by a certain multiple, the current size of the first proportional gain factor KPP<1:0> or the second proportional gain factor KPN<1:0> may be controlled to increase non-linearly. Therefore, the proportional control circuit 140 may control the size of the first current IPWR.P to be increased, as the error component of the output voltage VOUT increases.

As described above, the proportional control circuit 140 may multiply the first and second proportional gain factors KPP<1:0> and KPN<1:0> by the error code LV<6:0> so as to produce a multiplication result, and synchronizes the multiplication result to the proportional control signal PPULSE, and output the pull-up control signal POUTP<6:0> and the pull-down control signal POUTN<6:0>. Also, the first array driver 160 may include both of the pull-up array unit 162, which is realized with PMOS transistors, and the pull-down array unit 164, which is realized with NMOS transistors. Therefore, when an undershoot occurs in the output voltage VOUT, the proportional control circuit 140 of the proposed invention may increase the first current IPWR.P by using the pull-up array unit 162. When an overshoot occurs in the output voltage VOUT, the proportional control circuit 140 may maintain the output voltage VOUT at a uniform level by using the pull-down array unit 164 to decrease the first current IPWR.P and performing a fast regulation operation.

Figure 11:
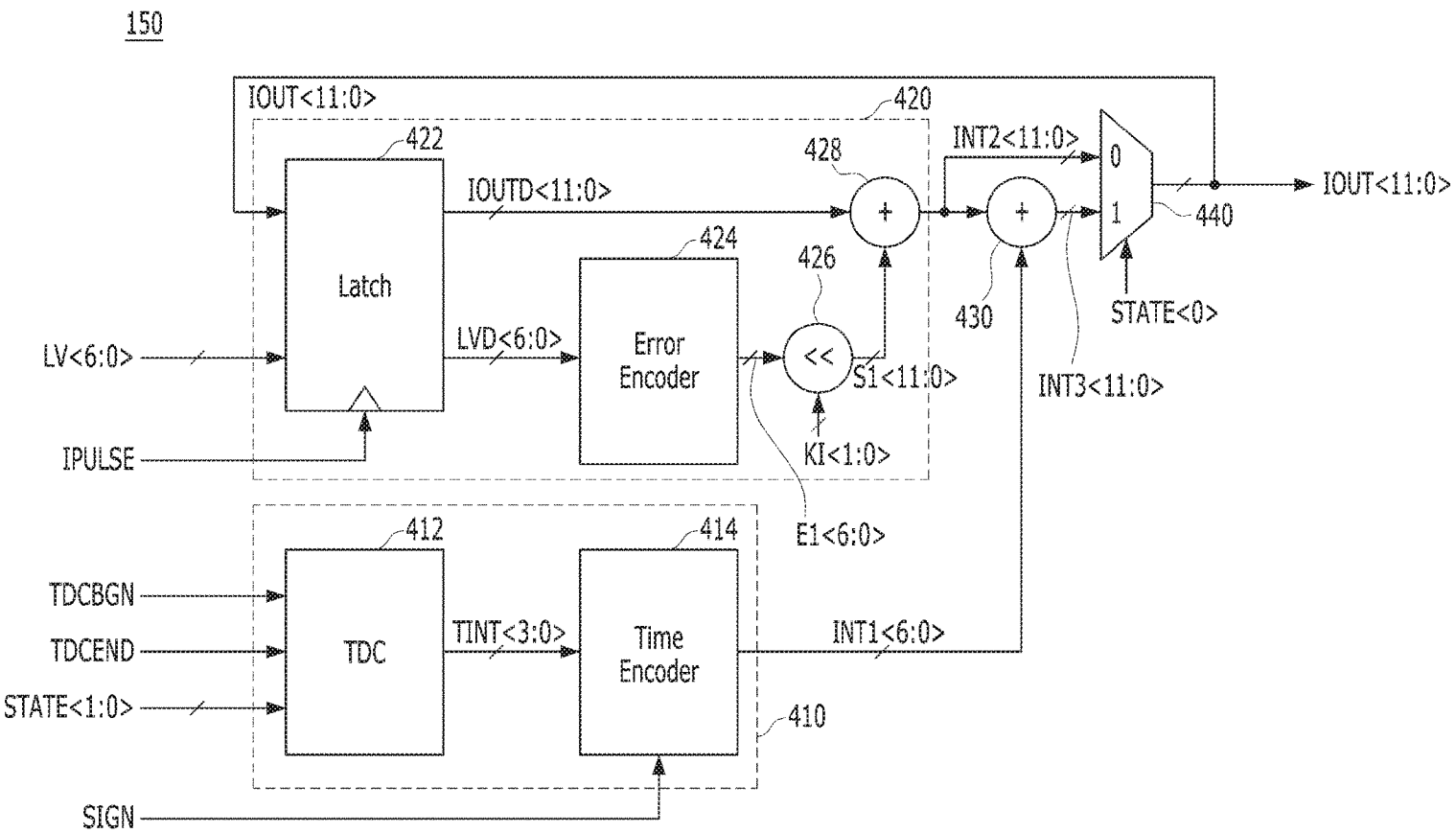
FIG. 11 is a block diagram illustrating the integral control circuit shown in FIG. 3.

FIG. 11 is a block diagram illustrating the integral control circuit 150 shown in FIG. 3.

Referring to FIG. 11, the integral control circuit 150 may include an initial driving unit 410, an integral driving unit 420, a summation unit 430, and a selection unit 440.

The initial driving unit 410 may estimate the current change ΔILOAD of the output node OUT_ND during the initialization section according to the state information signal STATE<1:0> and output the first integral signal INT1<6:0>.

To be specific, the initial driving unit 410 may include a time-to-digital converter (TDC) 412 and a time encoder 414.

The TDC 412 may calculate an activation interval ΔT between the start signal TDCBGN and the end signal TDCEND based on the state information signal STATE<1:0>, and generate a digital time control code TINT<3:0> which corresponds to the calculation result. Herein, the time control code TINT<3:0> may be formed of a thermometer code (i.e., a unary code). According to an embodiment of the present invention, the TDC 412 may be reset according to the state information signal STATE<1:0> of "00" which corresponds to the steady state section.

The time encoder 414 may output the first integral signal INT1<6:0> by encoding the time control code TINT<3:0> based on the error sign signal SIGN. The time encoder 414 may convert the time control code TINT<3:0>, which is a thermometer code, into the first integral signal INT1<6:0>, which is a binary code.

The integral driving unit 420 may latch the error code LV<6:0> and the second drive signal IOUT<11:0> based on the integral control signal IPULSE, shift an error code LVD<6:0> which is latched based on the integral gain factor KI<1:0> so as to produce a shifting result S1<11:0>, sum up the shifting result S1<11:0> with the latched second drive signal IOUTD<11:0>, and output a second integral signal INT2<11:0>. In other words, the integral driving unit 420 may perform an integral control operation that accumulatively sums up the previously stored error information (which is the latched second drive signal IOUTD<11:0>) and the currently stored error information (which is the shifting result S1<11:0>).

To be specific, the integral driving unit 420 may include a latch 422, an error encoder 424, a shifter 426, and an adder 428.

The latch 422 may latch the second drive signal IOUT<11:0> and the error code LV<6:0> when the integral control signal IPULSE is inputted, and output the latched second drive signal IOUTD<11:0> and the latched error code LVD<6:0>. The latch 422 may be formed of separate latch circuits that are distinguished from each other to respectively latch the second drive signal IOUT<11:0> and the error code LV<6:0>. The error encoder 424 may encode the latched error code LVD<6:0> to output an encoded signal E1<6:0>. The error encoder 424 may convert the latched error code LVD<6:0>, which is a thermometer code, into the encoded signal E1<6:0>, which is a binary code. The shifter 426 may generate a shifting signal S1<11:0> by shifting the encoded signal E1<6:0> based on the integral gain factor KI<1:0>. The adder 428 may output the second integral signal INT2<11:0> by summing up the latched drive signal IOUTD<11:0> and the shifting signal S1<11:0>.

The summation unit 430 may output a third integral signal INT3<11:0> by summing up the first integral signal INT1<6:0> and the second integral signal INT2<11:0>.

The selection unit 440 may select one between the second integral signal INT2<11:0> and the third integral signal INT3<11:0> based on the state information signal STATE<1:0> and output the second drive signal IOUT<11:0>. For example, the selection unit 440 may select the third integral signal INT3<11:0> based on the state information signal STATE<1:0> of "10" which corresponds to the initialization section, and select the second integral signal INT2<11:0> based on the state information signal STATE<1:0> of "11" which corresponds to the integration section. According to the embodiment, the selection unit 440 may select one between the second integral signal INT2<11:0> and the third integral signal INT3<11:0> based on the first bit STATE<0> of the state information signal STATE<1:0> that is capable of distinguishing the integration section.

As described above, the integral control circuit 150 may output the third integral signal INT3<11:0> that is generated by summing up the first integral signal INT1<6:0>, which is generated by estimating the current change ΔILOAD of the output node OUT_ND with respect to the activation interval ΔT during the initialization section, and the second integral signal INT2<11:0>, which is generated in the existing integration section, as the second drive signal IOUT<11:0>. In other words, the integral control circuit 150 may sum up the error information obtained by estimating the current change ΔILOAD during the initialization section and the previously stored error information (i.e., the latched second drive signal IOUTD<11:0>) and output the second drive signal IOUT<11:0>. Subsequently, the integral control circuit 150 may perform a typical integral control operation that accumulatively sums up the previously stored error information (i.e., the latched second drive signal IOUTD<11:0>) with the currently stored error information (i.e., the shifting result S1<11:0>) during the integration section. Therefore, in the integral control operation, it is possible to perform a fast regulation operation by rapidly setting the initial value to the previous final target value without a feedback process during the initialization section.

Figure 12:
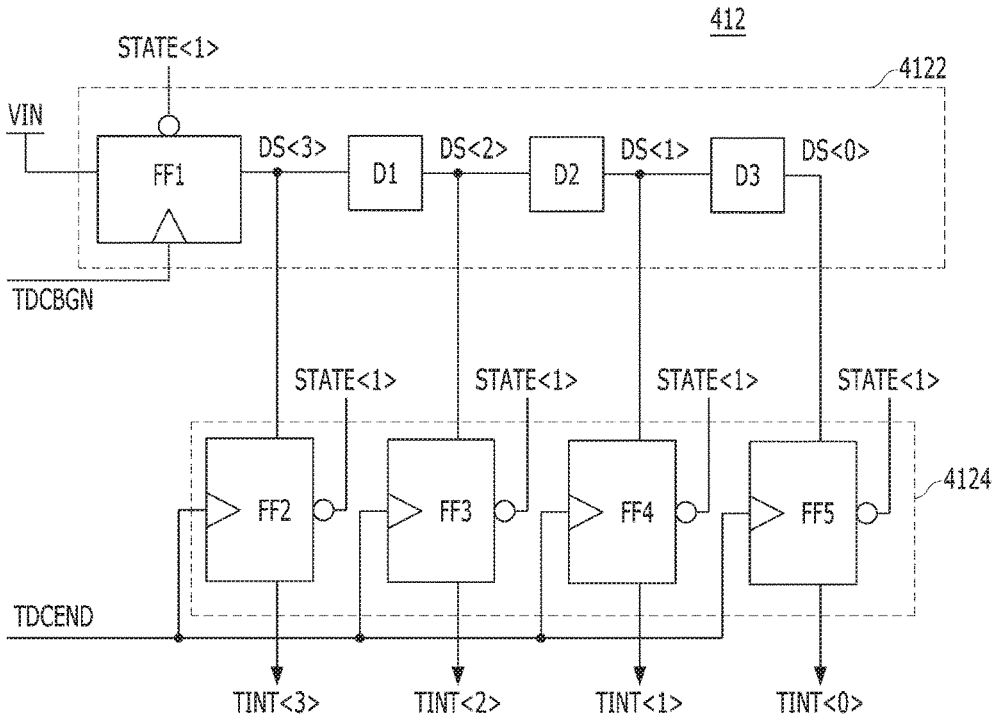
FIG. 12 is a block diagram illustrating a time-to-digital converter (TDC) shown in FIG. 11.

FIG. 12 is a block diagram illustrating the time-to-digital converter (TDC) 412 shown in FIG. 11.

Referring to FIG. 12, the TDC 412 may include a buffering element 4122 and a sampling element 4124.

The buffering element 4122 may sequentially delay an input signal (for example, a signal of a logic high level) based on the start signal TDCBGN and output a multi-bit delay code DS<3:0>. The buffering element 4122 may include a first flip-flop FF1 and first to third delayers D1 to D3. The first flip-flop FF1 may be reset based on the state information signal STATE<1:0> and latch the input signal based on the start signal TDCBGN, and output a fourth bit DS<3> of the delay code DS<3:0>. The first to third delayers D1 to D3 may sequentially delay the fourth bit DS<3> and output a third bit DS<2>, a second bit DS<1>, and a first bit DS<O> of the delay code DS<3:0>, respectively. In other words, the buffering element 4122 may output the delay code DS<3:0> that is sequentially activated when the start signal TDCBGN is activated. Herein, the delay code DS<3:0> may be formed of a thermometer code (which is a unary code).

The sampling element 4124 may sample each bit of the delay code DS<3:0> based on the end signal TDCEND and output the time control code TINT<3:0>. The sampling element 4124 may include second to fifth flip-flops that are reset based on the state information signal STATE<1:0>, latch each bit of the delay code DS<3:0> based on the end signal TDCEND, and output the time control code TINT<3:0>.

Meanwhile, first to fifth flip-flops FF1 to FF5 may be reset based on the second bit STATE<1> of the state information signal STATE<1:0> which is capable of distinguishing a steady state section. In other words, the first to fifth flip-flops FF1 to FF5 may be reset in the steady state section. According to the embodiment of the present invention, the first to fifth flip-flops FF1 to FF5 may be reset based on an internal reset pulse (which is RSTB_INIT in FIG. 6) generated based on a global reset signal (not shown) and the steady state detection signal STEADYB.

Figure 13:
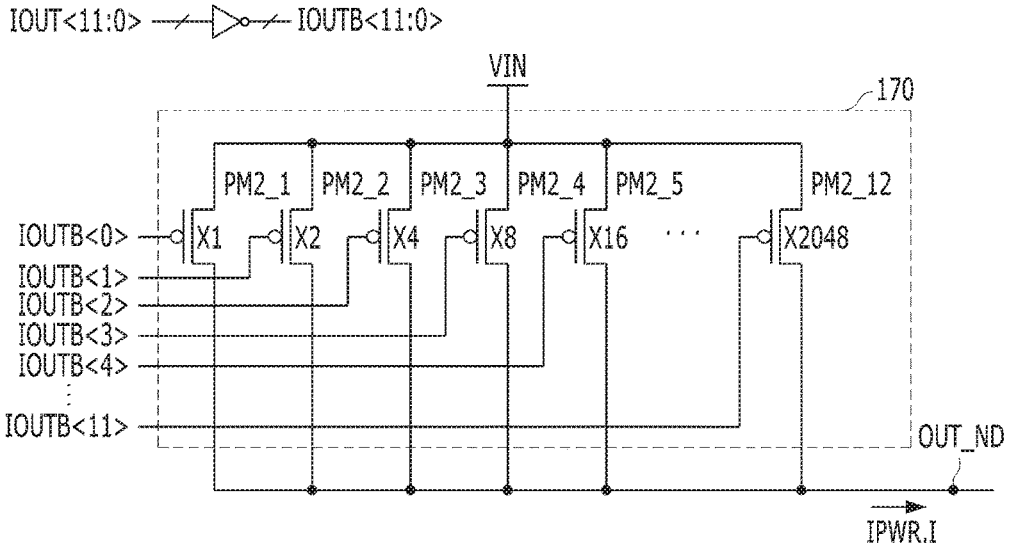
FIG. 13 is a block diagram illustrating a second array driver shown in FIG. 3.

FIG. 13 is a block diagram illustrating the second array driver 170 shown in FIG. 3.

Referring to FIG. 13, the second array driver 170 may include first to $12^{th}$ pull-up transistors PM2_1 to PM2_12 that are coupled in parallel between the power source voltage VIN terminal and the output node OUT_ND and receive each bit of the inverted second drive signal IOUTB<11:0> through gates. Therefore, the second array driver 170 may control the number of the pull-up transistors PM2_1 to PM2_12 that are turned on in response to the inverted second drive signal IOUTB<11:0>. According to an embodiment of the present invention, the first to $12^{th}$ pull-up transistors PM2_1 to PM2_12 may be realized with PMOS transistors.

The first to $12^{th}$ pull-up transistors PM2_1 to PM2_12 may be formed to have a size (W/L) that increases by two times, just as in the first array driver 160. Since the first to 12th pull-up transistors PM2_1 to PM2_12 have a size increasing by a certain multiple, the current size according to the integral gain factor KI<1:0> may be controlled to increase non-linearly. Accordingly, the integral control circuit 150 may control the size of the second current IPWR.I to be increased as the error component of the output voltage VOUT becomes larger.

Hereinafter, the operation of the integral control circuit 150 is described with reference to FIGS. 11 to 15.

Figure 14:
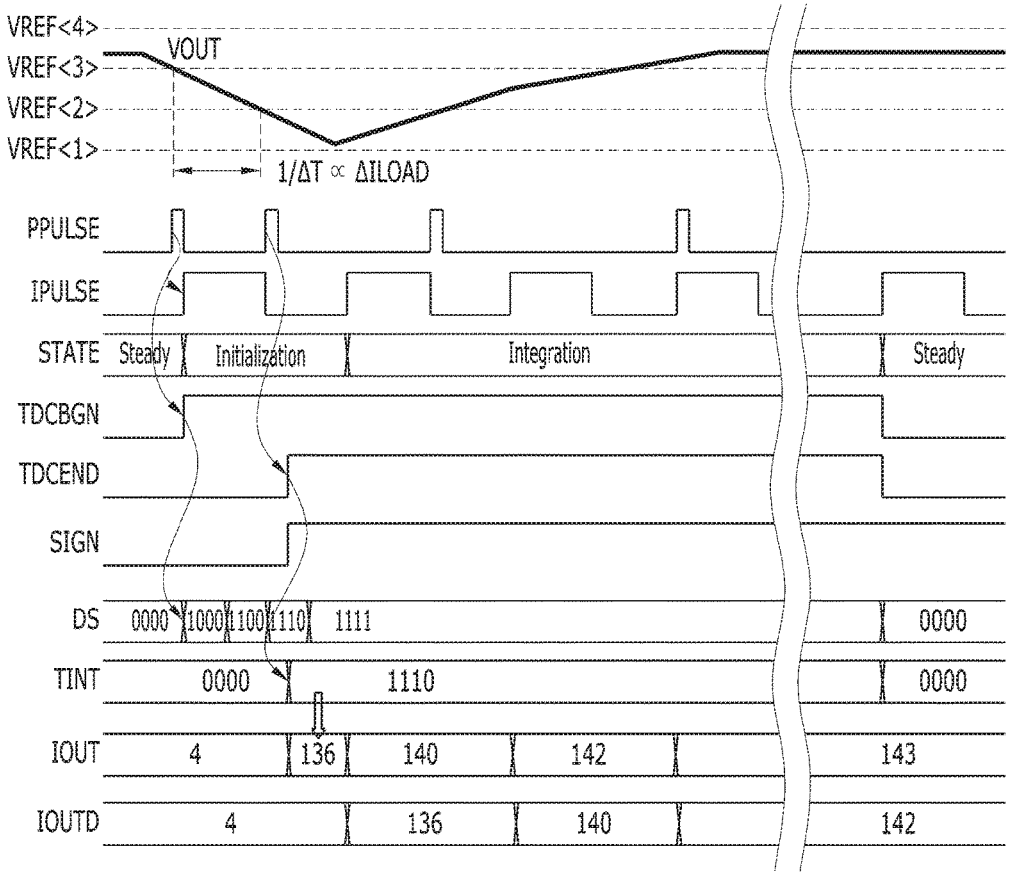
FIGS. 14 and 15 are timing diagrams illustrating an operation of the integral control circuit shown in FIG. 11.
Figure 15:
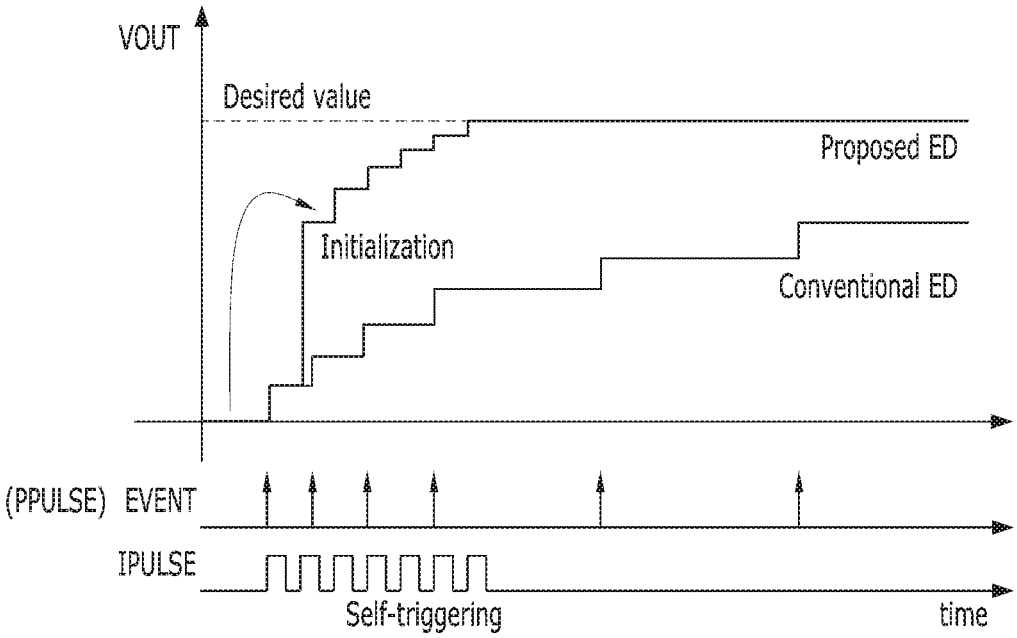

FIGS. 14 and 15 are timing diagrams illustrating an operation of the integral control circuit 150 shown in FIG. 11.

Referring to FIG. 14, when the steady-state analog output voltage VOUT is inputted, the proportional control signal PPULSE and the integral control signal IPULSE may be deactivated, and the state information signal STATE<1:0> may be set to "00" which corresponds to the steady state section. As a result, both of the start signal TDCBGN and the end signal TDCEND may be deactivated, and the TQC 412 may be reset based on the state information signal STATE<1:0> of "00". Since the proportional control signal PPULSE and the integral control signal IPULSE are all deactivated in the steady state, the proportional control circuit 140 and the integral control circuit 150 may not perform a regulation operation. Herein, it is assumed that the second drive signal IOUT<11:0> is set to "4".

Subsequently, when an undershoot of the output voltage VOUT occurs, the proportional control signal PPULSE may pulse, and the start signal TDCBGN may be activated in response to the first activation of the proportional control signal PPULSE, and the end signal TDCEND may be activated in response to the second activation of the proportional control signal PPULSE. Also, the state information signal STATE<1:0> of "10" which corresponds to the initialization section may be generated during a first cycle of the integral control signal IPULSE. Also, the inverted signal LVB<3> of the fourth bit LV<3> may be outputted as the error sign signal SIGN, when the end signal TDCEND is activated.

The TDC 412 of the initial driving unit 410 may calculate the activation interval ΔT between the start signal TDCBGN and the end signal TDCEND during the initialization section and generate the digital time control code TINT<3:0> which corresponds to the calculation result.

To be more specific, the buffering element 4122 of the TDC 412 may sequentially delay an input signal of a logic high level when the start signal TDCBGN is activated, and output a delay code DS<3:0>. Herein, the delay code DS<3:0> may be sequentially changed from "1000"→"1100"→"1110"→"1111" as time passes. Also, the sampling element 4124 may sample each bit of the delay code DS<3:0> and output a time control code TINT<3:0> when the end signal TDCEND is activated. That is, the time control code TINT<3:0> may be outputted as "1110", which is the value of the delay code DS<3:0> when the end signal TDCEND is activated. The time encoder 414 may encode the time control code TINT<3:0> according to the error sign signal SIGN and output a first integral signal INT1<6:0>.

The summation unit 430 may output the third integral signal INT3<11:0> by summing up the first integral signal INT1<6:0> and the second integral signal INT2<11:0>. The selection unit 440 may output the third integral signal INT3<11:0> as the second drive signal IOUT<11:0> according to the state information signal STATE<1:0> of "10" which corresponds to the initialization section. For example, the second drive signal IOUT<11:0> may be outputted as "136" by summing up "4" of the second integral signal INT2<11:0> with "132" of the first integral signal INT1<11:0>.

Herein, since the change of the output voltage VOUT is not large, the output voltage VOUT may return to the steady state before the second activation of the proportional control signal PPULSE.

In this case, the start signal TDCBGN is activated, but the end signal TDCEND and the error sign signal SIGN may remain deactivated. Since the end signal TDCEND is not activated, the sampling element 4124 may not update the time control code TINT<3:0>. Therefore, since the first integral signal INT1<6:0> is not generated, "4" of the previous second integral signal INT2<11:0> may be outputted as it is as the second drive signal IOUT<11:0>.

When the integral control signal IPULSE is activated and the steady state detection signal STEADYB may be deactivated after the first cycle of the integral control signal IPULSE, the state information signal STATE<1:0> of "11" corresponding to the integration section may be generated.

The integral driving unit 420 may latch the error code LV<6:0> and the second drive signal IOUT<11:0> according to the integral control signal IPULSE, shift the latched error code LVD<6:0> based on the integral gain factor KI<1:0>, sum up the shifting result S1<11:0> and the latched second drive signal IOUTD<11:0>, and output the second integral signal INT2<11:0>. Herein, the selection unit 440 may select the second integral signal INT2<11:0> and output the second drive signal IOUT<11:0> according to the state information signal STATE<1:0> of "11" which corresponds to the integration section. For example, the second drive signal IOUT<11:0> may be outputted as "140" of the second integral signal INT2<11:0>.

Subsequently, the integral control circuit 150 may output the second integral signal INT2<11:0> as the second drive signal IOUT<11:0> according to the integral control signal IPULSE that is continuously triggered until it becomes a steady state according to the self-triggering scheme.

Referring to FIG. 15, the integral control circuit 150 according to the embodiment of the present invention may output the third integral control signal INT3<11:0> that is generated by summing up the first integral signal INT1<6:0>, which is generated by estimating the current change ΔILOAD of the output node OUT_ND, with the second integral signal INT2<11:0>, which is generated in the existing integration section, during the initialization section corresponding to the first cycle of the integral control signal IPULSE. That is, since the integral control circuit 150 according to the embodiment of the present invention adjusts the output voltage VOUT to reach the target voltage during the integration section after compensating for the estimated current change ΔILOAD during the initialization section, the integral control circuit 150 according to the embodiment of the present invention may require a much shorter latency than the latency of the general integral control circuit.

Also, since the integral control circuit is driven according to the self-triggering scheme in the initial regulation operation, it is possible to improve not only the response time but also the settling time, and since it does not need to require a complex circuit necessary for solving a stick problem, it is possible to decrease the area and reduce the power consumption.

Also, the event-driven digital LDO regulator 100 according to the embodiment of the present invention may be realized by forming the proportional control circuit 140 and the integral control circuit 150 in parallel schemes by individually including the first array driver 160 for proportional control and the second array driver 170 for integral control. In other words, the control loop latency may be reduced and the regulation performance may be improved by adding the first current IPWR.P obtained by controlling the first array driver 160 and the second current IPWR.I obtained by controlling the second array driver 170 in the form of current in a current domain so as to remove the existing adder. Also, the event-driven digital LDO regulator 100 according to the embodiment of the present invention may be able to compensate for the undershoot and overshoot of the output voltage VOUT, as the proportional-control first array driver 160 includes both of the pull-up array unit 162, which compensates for the undershoot of the output voltage VOUT, and the pull-down array unit 164, which compensates for the overshoot of the output voltage VOUT.

According to the embodiments of the present invention, the digital low Drop-Out (LDO) regulator may reduce a settling time by quickly performing an integral calculation based on a self-triggering scheme and a fast initialization operation in the initial regulation operation. Since the settling time may be improved as well as improving the response time, there is an effect that the performance of the regulator may be improved.

Also, since the digital LDO regulator in accordance with the embodiments of the present invention drives the integral control circuit according to the self-triggering scheme in the initial regulation operation, there is no need to provide a complicated circuit which is necessary to solve a sticking concern, thereby reducing the area and power consumption.

While the present invention has been described with respect to the specific embodiments, it will be apparent to those skilled in the art that various changes and modifications may be made without departing from the spirit and scope of the invention as defined in the following claims.

For example, a logic gate and a transistor exemplarily described in the embodiments of the present invention described above may be realized to have different positions and types according to the polarity of an inputted signal.

What is claimed is:

1. A digital Low Drop-Out (LDO) regulator, comprising:

a pulse control circuit suitable for generating a proportional control signal based on an error code that corresponds to a change in an output voltage, generating an integral control signal that toggles during a first section, which includes an initialization section and an integration section, based on the proportional control signal, and generating a state information signal that defines a steady state section, the initialization section, and the integration section;

a proportional control circuit suitable for outputting a first drive signal by multiplying the error code by a proportional gain factor based on the proportional control signal;

an integral control circuit suitable for outputting a second drive signal by multiplying the error code by an integral gain factor based on the state information signal and the integral control signal; and a driver suitable for adjusting the output voltage in response to the first drive signal and the second drive signal.

2. The digital LDO regulator of claim 1, wherein the pulse control circuit defines a section which begins according to a first activation of the proportional control signal and ends when the error code corresponding to a steady state of the output voltage is maintained during a predetermined cycle of the integral control signal as the first section, and defines a section excluding the first section as the steady state section.

3. The digital LDO regulator of claim 2, wherein the first section includes:

the initialization section that is maintained during at least one initial cycle of the integral control signal; and the integration section that is a section excluding the initialization section.

4. The digital LDO regulator of claim 1, wherein the integral control circuit, based on the state information signal, outputs the second drive signal by estimating a current change of an output node during the initialization section so as to produce an estimated current change and summing up the estimated current change with a previous second drive signal, and outputs the second drive signal by summing up a multiplication result obtained by multiplying the integral gain factor by the error code with the previous second drive signal based on the integral control signal during the integration section.

5. The digital LDO regulator of claim 1, wherein the error code is formed of a unary code.

6. The digital LDO regulator of claim 1, wherein the pulse control circuit includes:

a control signal generation unit suitable for generating the proportional control signal that pulses when the error code is changed; and a self-trigger control unit suitable for generating a steady state detection signal for detecting the steady state section, the integral control signal, and the state information signal based on the proportional control signal and the error code.

7. The digital LDO regulator of claim 6, wherein the control signal generation unit includes:

a pulse generator suitable for generating a multi-bit pulse signal that pulses at a predetermined section whenever each bit of the error code is changed; and a signal outputter suitable for generating the proportional control signal that is activated when even one among bits of the multi-bit pulse signal is activated.

8. The digital LDO regulator of claim 6, wherein the self-trigger control unit includes:

a section controller suitable for generating a section control signal which is activated based on the proportional control signal and deactivated based on the steady state detection signal;

an oscillator that is enabled based on the section control signal and generates the integral control signal that toggles at a predetermined cycle;

a steady state detector suitable for generating the steady state detection signal which is activated when the error code corresponding to the steady state is maintained for a predetermined cycle of the integral control signal; and a finite state machine (FSM) suitable for generating the state information signal based on the integral control signal and the steady state detection signal.

9. The digital LDO regulator of claim 8, wherein the steady state detector includes:

an error signal generation element suitable for generating an error detection signal by detecting whether or not the error code corresponding to the steady state is inputted;

an N-bit shift register element suitable for outputting an N-bit counting signal by sequentially shifting the error detection signal based on the integral control signal; and a signal generation element suitable for generating the steady state detection signal based on the N-bit counting signal.

10. The digital LDO regulator of claim 8, wherein the finite state machine generates the state information signal of a first value which corresponds to the steady state section, when the integral control signal is deactivated and the steady state detection signal is activated, transitions the state information signal into a second value which corresponds to the initialization section, when the state information signal has the first value, at a rising edge of the integral control signal, transitions the state information signal into a third value which corresponds to the integration section, when the state information signal has the second value, at a rising edge of the integral control signal, and maintains the state information signal to be the third value, when the steady state detection signal is deactivated while the state information signal has the third value, and transitions the state information signal into the first value, when the steady state detection signal is activated, at a rising edge of the integral control signal.

11. The digital LDO regulator of claim 6, wherein the integral control circuit includes:

an initial driving unit suitable for outputting a first integral signal by estimating a current change of the output node during the initialization section based on the state information signal;

an integral driving unit suitable for outputting a second integral signal by summing up a multiplication result which is obtained by multiplying the integral gain factor by the error code based on the integral control signal with the previous second drive signal;

a summation unit suitable for outputting a third integral signal by summing up the first integral signal with the second integral signal; and a selection unit suitable for outputting the second drive signal by selecting one between the second integral signal and the third integral signal based on the state information signal.

12. The digital LDO regulator of claim 11, wherein the initial driving unit includes:

a time-to-digital converter (TDC) suitable for calculating an activation interval between a start signal which is activated according to a first activation of the proportional control signal and an end signal which is activated according to a second activation of the proportional control signal based on the state information signal, and generating a time control code corresponding to the calculated activation interval; and a time encoder suitable for outputting the first integral signal by encoding the time control code based on an error sign signal.

13. The digital LDO regulator of claim 12, wherein the time-to-digital converter includes:

a buffering element that outputs a multi-bit delay code by sequentially delaying an input signal of a logic high level based on the start signal; and a sampling element that outputs the time control code by sampling each bit of the delay code based on the end signal, wherein the buffering element and the sampling element are reset based on the state information signal.

14. The digital LDO regulator of claim 11, wherein the integral driving unit includes:

a latch suitable for latching each of the previous second drive signal and the error code so as to produce a latched drive signal and a latched error code and outputting the latched drive signal and the latched error code in response to the integral control signal;

an error encoder suitable for encoding the latched error code and outputting an encoding signal;

a shifter suitable for shifting the encoding signal and generating a shifting signal based on the integral gain factor; and an adder suitable for adding the latched drive signal with the shifting signal and outputting the second integral signal.

15. The digital LDO regulator of claim 1, wherein the proportional control circuit includes:

a latch unit suitable for latching the error code based on the proportional control signal;

a first shift register unit suitable for outputting a pull-up drive signal of the first drive signals by shifting a first bit group of the latched error code based on a first proportional gain factor; and a second shift register unit suitable for outputting a pull-down drive signal of the first drive signals by shifting a second bit group of the latched error code based on a second proportional gain factor.

16. The digital LDO regulator of claim 1, wherein the driver includes:

a first array driver suitable for adjusting a driving force of a first current and outputting the first current of the adjusted driving force to an output node in response to the first drive signal; and a second array driver suitable for adjusting a driving force of a second current and outputting the second current of the adjusted driving force to the output node in response to the second drive signal.

17. The digital LDO regulator of claim 16, wherein the first array driver includes:

a pull-up array unit that includes a plurality of pull-up transistors which are coupled in parallel between a power source voltage terminal and the output node, and controls the number of pull-up transistors which are turned on in response to a pull-up drive signal of the first drive signal; and a pull-down array unit that includes a plurality of pull-down transistors which are coupled in parallel between the output node and a ground voltage terminal, and controls the number of pull-down transistors which are turned on in response to a pull-down drive signal of the first drive signal.

18. The digital LDO regulator of claim 16, wherein the second array driver includes a plurality of pull-up transistors which are coupled in parallel between the power source voltage terminal and the output node, and controls the number of pull-up transistors which are turned on in response to the second drive signal.

19. A digital Low Drop-Out (LDO) regulator, comprising:

a self-trigger control unit suitable for generating an integral control signal that starts toggling when a change in an output voltage is detected and stops toggling when a steady state of the output voltage is detected;

an initial driving unit suitable for outputting a first integral signal by estimating a current change of an output node during an initialization section;

an integral driving unit suitable for outputting a second integral signal by summing up a multiplication result which is obtained by multiplying an integral gain factor by an error code corresponding to the output voltage based on the integral control signal with a previous drive signal;

a selection unit suitable for outputting a third integral signal which is generated by summing up the first integral signal with the second integral signal during the initialization section as a drive signal, and outputting the second integral signal as the drive signal during an integration section; and an array driving unit suitable for adjusting the output voltage based on the drive signal.

20. The digital LDO regulator of claim 19, wherein the self-trigger control unit includes:

a section controller suitable for generating a section control signal which is activated when a change in the output voltage is detected and deactivated based on a steady state detection signal;

an oscillator that is enabled based on the section control signal and generates the integral control signal that toggles at a predetermined cycle; and a steady state detector suitable for generating the steady state detection signal which is activated when a steady state of the output voltage is maintained for a predetermined cycle of the integral control signal.

21. The digital LDO regulator of claim 19, wherein the initial driving unit includes:

a time-to-digital converter (TDC) suitable for calculating an activation interval between a start signal which is activated according to a first activation of a proportional control signal that pulses when the output voltage is changed and an end signal which is activated according to a second activation of the proportional control signal, and generating a time control code corresponding to the calculated activation interval during the initialization section; and a time encoder suitable for outputting the first integral signal by encoding the time control code based on an error sign signal.

22. The digital LDO regulator of claim 19, wherein the integral driving unit includes:

a latch suitable for latching each of the previous drive signal and the error code so as to produce a latched drive signal and a latched error code and outputting the latched drive signal and the latched error code in response to the integral control signal;

an error encoder suitable for encoding the latched error code and outputting an encoding signal;

a shifter suitable for shifting the encoding signal and generating a shifting signal based on the integral gain factor; and an adder suitable for adding the latched drive signal with the shifting signal and outputting the second integral signal.

23. A method for operating a digital Low Drop-Out (LDO) regulator, comprising:

generating an error code by detecting a change in an output voltage;

activating a proportional control signal whenever the error code is changed, generating an integral control signal that toggles during a first section which includes an initialization section and an integration section based on the proportional control signal, and generating a state information signal that defines a steady state section, the initialization section, and the integration section;

outputting a first drive signal by multiplying a proportional gain factor by the error code based on the proportional control signal;

outputting a second drive signal by multiplying an integral gain factor by the error code based on the state information signals and the integral control signal; and adjusting the output voltage in response to the first drive signals and the second drive signal.

24. The method of claim 23, wherein the first section is defined as a section which begins according to a first activation of the proportional control signal and ends when the error code corresponding to a steady state of the output voltage is maintained during a predetermined cycle of the integral control signal, and the steady state section is defined as a section excluding the first section.

25. The method of claim 24, wherein the first section includes:

the initialization section that is maintained during at least one initial cycle of the integral control signal; and the integration section that is a section excluding the initialization section.

26. The method of claim 23, wherein the outputting of the second drive signal includes:

outputting, based on the state information signal, the second drive signal by estimating a current change of an output node during the initialization section to produce an estimated current change and summing up the estimated current change with a previous second drive signal; and outputting, based on the state information signal, the second drive signal by summing up a multiplication result obtained by multiplying the integral gain factor by the error code with the previous second drive signal based on the integral control signal during the integration section.

27. The method of claim 23, wherein the generating of the integral control signal that toggles during the first section which includes the initialization section and the integration section based on the proportional control signal includes:

generating the integral control signal that toggles at a predetermined cycle based on the proportional control signal;

deactivating a steady state detection signal when the error code corresponding to a steady state of the output voltage is maintained for a predetermined cycle of the integral control signal; and stopping toggling of the integral control signal in response to the steady state detection signal.

* * * * *